US007549630B2

(12) United States Patent
Sugimura et al.

(10) Patent No.: US 7,549,630 B2
(45) Date of Patent: Jun. 23, 2009

(54) SHEET SUPPLYING DEVICE AND IMAGE FORMING DEVICE

(75) Inventors: Naoto Sugimura, Saitama-ken (JP); Yasuhiro Kurokawa, Saitama-ken (JP)

(73) Assignee: Fuji Xerox Co., Ltd., Tokyo (JP)

( * ) Notice: Subject to any disclaimer, the term of this patent is extended or adjusted under 35 U.S.C. 154(b) by 432 days.

(21) Appl. No.: 10/872,540

(22) Filed: Jun. 22, 2004

(65) Prior Publication Data

US 2005/0140081 A1 Jun. 30, 2005

(30) Foreign Application Priority Data

Dec. 26, 2003 (JP) ..... 2003-432569

(51) Int. Cl.
*B65H 3/06* (2006.01)

(52) U.S. Cl. ..... 271/117

(58) Field of Classification Search ..... 271/117, 271/118, 126, 127, 147, 157, 160
See application file for complete search history.

(56) References Cited

U.S. PATENT DOCUMENTS

| | | | | |
|---|---|---|---|---|
| 7,270,323 | B2 * | 9/2007 | Somemiya | 271/127 |
| 2004/0256789 | A1 * | 12/2004 | Hsu | 271/126 |

FOREIGN PATENT DOCUMENTS

| | | | |
|---|---|---|---|
| JP | 61-7168 | * | 1/1986 |
| JP | 63-123729 | * | 5/1988 |
| JP | 2-193830 | * | 7/1990 |
| JP | 7-14271 | * | 4/1995 |
| JP | 2619959 B2 | | 3/1997 |
| JP | 11-255345 | * | 9/1999 |
| JP | 2001-278461 | * | 10/2001 |
| JP | 2002-274664 | * | 9/2002 |
| JP | 2002-332125 | | 11/2002 |

* cited by examiner

*Primary Examiner*—Patrick H Mackey
*Assistant Examiner*—Thomas A Morrison
(74) *Attorney, Agent, or Firm*—Morgan Lewis & Bockius LLP

(57) ABSTRACT

A sheet supplying device has: a base; a tray; a feed roller provided rotatably at the base and positioned above the tray. When the feed roller rotates while frictionally engaging with a topmost sheet of the stack of sheets, the feed roller can convey the sheet. The sheet supplying device further includes a driving mechanism able to drive the feed roller to rotate; an urging member urging the tray toward the feed roller; a first eccentric cam rotatably provided at the base, and including a large-radius outer peripheral portion and a small-radius outer peripheral portion, the first eccentric cam rotating interlockingly with rotation of the feed roller; and a second eccentric cam rotatably provided at the tray, and including a large-radius outer peripheral portion and a small-radius outer peripheral portion, the second eccentric cam being able to engage with the first eccentric cam.

11 Claims, 17 Drawing Sheets

SHEET SUPPLYING DEVICE AND IMAGE FORMING DEVICE

CROSS-REFERENCE TO RELATED APPLICATION

This application claims priority under 35 USC 119 from Japanese Patent Application No. 2003-432569, the disclosure of which is incorporated by reference herein.

BACKGROUND OF THE INVENTION

1. Field of the Invention

The present invention relates to an image forming device which records images on sheets of recording media (papers or the like of predetermined sizes), and to a sheet supplying device which conveys sheets one-by-one from a stack of sheets.

2. Description of the Related Art

Generally, in an image forming device such as a copier or a printer or the like, images are formed on recording media sheets in an image forming section. These sheets are stacked in a sheet supplying device which is provided within the image forming device, and are successively supplied from the sheet supplying device to the image forming section.

As shown in FIG. 16, a sheet supplying device 100 has a presser plate 102 on which sheets (recording media) are placed. The presser plate 102 is urged upward by a coil spring 104. Above the presser plate 102, a supporting shaft 106 is supported so as to rotate freely with respect to a main body frame 130 (not all of the main body frame 130 is illustrated). A feed roller 108, which is half-moon-shaped and conveys the sheets, is fixed to the supporting shaft 106. Core rollers 110 are attached to the both sides of the feed roller 108. The core rollers 110 rotate in a state of contacting a separating pad 112 provided at the main body frame 130.

Cams 114 are fixed to the both end portions of the supporting shaft 106. The cams 114 abut rollers 124 provided at flanges 122 which project from the both side portions of the presser plate 102.

A driven gear 116 is attached to one end portion of the supporting shaft 106. A portion of the peripheral surface of the driven gear 116 is cut out. A driving gear 118, which is driven to rotate by a motor (not illustrated), is meshably disposed at the lower side of the driven gear 116. The driving gear 118 meshes with the driven gear 116 at a predetermined timing so as to transmit the driving force of the driving gear 118 to the driven gear 116, such that the supporting shaft 106 can rotate one time.

As shown in FIG. 17A, at times other than when sheets are being fed, the portions of the cams 114 where the eccentric radii are large abut the rollers 124 of the presser plate 102, and press the presser plate 102 downward in a direction resisting the urging force of the coil spring 104. At this time, the sheets stacked on the presser plate 102 are set apart from the feed roller 108.

As shown in FIG. 17B, when the cams 114 rotate in the direction of the arrow due to the rotation of the supporting shaft 106, the rollers 124 rotate while abutting the cams 114, and the presser plate 102 is pushed upward by the urging force of the coil spring 104. The feed roller 108 and the core rollers 110 also rotate together with the rotation of the supporting shaft 106.

As shown in FIG. 17C, when the cams 114 rotate further in the direction of the arrow, the rollers 124 move along the cams 114, and the presser plate 102 is gradually pushed upward. As shown in FIG. 17D, the presser plate 102 rises to the position at which the rollers 124 abut bearing portions 114*a* of the cams 114. At this time, the topmost portion of the stack of sheets stacked on the presser plate 102 contacts the feed roller 108, and the sheets are fed out as the feed roller 108 rotates. Conveying, in an overlapping manner, of the sheets which are fed out is prevented by the friction with the separating pad 112.

When the cams 114 rotate further, the presser plate 102 is pushed downward in the direction of resisting the urging force of the coil spring 104, and the cams 114 rotate one time. In this way, the presser plate 102 is lowered to the position shown in FIG. 17A. (See, for example, Japanese Patent No. 2619959.)

In the sheet supplying device 100 shown in FIG. 16, the presser plate 102 is moved upward and downward by the rotation of the cams 114 provided at the supporting shaft 106 of the feed roller 108, and feeding of the topmost sheet of the stack of sheets is carried out. However, when an attempt is made to increase the accommodating capacity (the feeding capacity) of the sheets stacked on the presser plate 102, a problem arises in that the cams 114 inevitably become large.

Namely, in the feeding operations shown in FIGS. 17A through 17D, when the presser plate 102 is raised, the topmost portion of the stack of sheets is pressed by the feed roller 108 and feeding is carried out. When the presser plate 102 is lowered, the topmost portion of the stack of sheets is moved away to a position at which it does not contact the feed roller 108. Accordingly, when an attempt is made to increase the sheet accommodating capacity, the stroke of the presser plate 102 must be made to be large, and the cams 114 become large. Namely, there is the relation that the size of the cams 114 which move the presser plate 102 upward and downward determine the sheet accommodating capacity. Accordingly, a way to satisfy the antithetical needs for an increase in the sheet accommodating capacity and a decrease in the overall size of the device is desired.

SUMMARY OF THE INVENTION

The present invention has been made in view of the above circumstances and provides a sheet supplying device and an image forming device which enable the device to be made compact overall and which enable an increase in the accommodating capacity of sheets (e.g., recording media).

In accordance with one aspect of the present invention, there is provided a sheet supplying device comprising: a base; a tray on which a stack of sheets can be placed, the tray being able to be raised and lowered with respect to the base; a feed roller provided rotatably at the base and positioned above the tray, and when the feed roller rotates while frictionally engaging with a topmost sheet of the stack of sheets, the feed roller can convey the sheet; a driving mechanism able to drive the feed roller to rotate; an urging member urging the tray toward the feed roller; a first eccentric cam rotatably provided at the base, and including a large-radius outer peripheral portion whose radius is large and a small-radius outer peripheral portion whose radius is small, the first eccentric cam rotating interlockingly with rotation of the feed roller; and a second eccentric cam rotatably provided at the tray, and including a large-radius outer peripheral portion whose radius is large and a small-radius outer peripheral portion whose radius is small, the second eccentric cam being able to engage with the first eccentric cam, wherein, when the respective small-radius outer peripheral portions of the first eccentric cam and the second eccentric cam substantially contact one another, the tray approaches the feed roller so as to be able to convey the sheet, and when the respective large-radius outer peripheral portions of the first eccentric cam and the second eccentric cam substantially contact one another, the tray moves away from the feed roller so as to be unable to convey the sheet.

In accordance with another aspect of the present invention, there is provided a sheet supplying device comprising: a base; a tray on which a stack of sheets can be placed, the tray being able to be raised and lowered with respect to the base; a feed roller provided rotatably at the base and positioned above the tray, and when the feed roller rotates while frictionally engaging with a topmost sheet of the stack of sheets, the feed roller can convey the sheet; a driving mechanism able to drive the feed roller to rotate; an urging member urging the tray toward the feed roller; a first eccentric cam provided rotatably at the base, and having a first rotating supporting shaft, and including a large-radius outer peripheral portion, whose radius is large, and a small-radius outer peripheral portion, whose radius is small, such that the first rotating supporting shaft is disposed between the large-radius outer peripheral portion and the small-radius outer peripheral portion, the first eccentric cam rotating interlockingly with rotation of the feed roller; a second eccentric cam provided rotatably at the tray, and having a second rotating supporting shaft, and including a large-radius outer peripheral portion, whose radius is large, and a small-radius outer peripheral portion, whose radius is small, such that the second rotating supporting shaft is disposed between the large-radius outer peripheral portion and the small-radius outer peripheral portion; and a third eccentric cam having a third rotating supporting shaft, and including a large-radius outer peripheral portion, whose radius is large, and a small-radius outer peripheral portion, whose radius is small, such that the third rotating supporting shaft is disposed between the large-radius outer peripheral portion and the small-radius outer peripheral portion, wherein the first rotating supporting shaft, the third rotating supporting shaft, and the second rotating supporting shaft are lined up in that order in a vertical direction and are separated from one another and parallel to one another, the third rotating supporting shaft can move translationally in the vertical direction, and in a first case in which the large-radius outer peripheral portion of the first eccentric cam substantially contacts one of the large-radius outer peripheral portion and the small-radius outer peripheral portion of the third eccentric cam, and the large-radius outer peripheral portion of the second eccentric cam substantially contacts another of the large-radius outer peripheral portion and the small-radius outer peripheral portion of the third eccentric cam, the tray moves away from the feed roller so as to be unable to convey the sheet, and in a second case in which the small-radius outer peripheral portion of the first eccentric cam substantially contacts the small-radius outer peripheral portion of the third eccentric cam, and the small-radius outer peripheral portion of the third eccentric cam substantially contacts the small-radius outer peripheral portion of the second eccentric cam, the tray approaches the feed roller so as to be able to convey the sheet.

In accordance with yet another aspect of the present invention, there is provided a sheet supplying device comprising: a base; a tray on which a stack of sheets can be placed, the tray being able to be raised and lowered with respect to the base; a feed roller provided rotatably at the base and positioned above the tray, and when the feed roller rotates while frictionally engaging with a topmost sheet of the stack of sheets, the feed roller can convey the sheet; a driving mechanism able to drive the feed roller to rotate; an urging member urging the tray toward the feed roller; a first eccentric cam provided rotatably at the base, and having a first rotating supporting shaft, and including a large-radius outer peripheral portion, whose radius is large, and a small-radius outer peripheral portion, whose radius is small, such that the first rotating supporting shaft is disposed between the large-radius outer peripheral portion and the small-radius outer peripheral portion, the first eccentric cam being able to rotate independently of rotation of the feed roller; a second eccentric cam provided rotatably at the tray, and having a second rotating supporting shaft, and including a large-radius outer peripheral portion, whose radius is large, and a small-radius outer peripheral portion, whose radius is small, such that the second rotating supporting shaft is disposed between the large-radius outer peripheral portion and the small-radius outer peripheral portion; and a third eccentric cam having a third rotating supporting shaft, and including a large-radius outer peripheral portion, whose radius is large, and a small-radius outer peripheral portion, whose radius is small, such that the third rotating supporting shaft is disposed between the large-radius outer peripheral portion and the small-radius outer peripheral portion, wherein the first rotating supporting shaft, the third rotating supporting shaft, and the second rotating supporting shaft are lined up in that order in a vertical direction and are separated from one another and parallel to one another, the third rotating supporting shaft can move translationally in the vertical direction, and in a first case in which the large-radius outer peripheral portion of the first eccentric cam substantially contacts one of the large-radius outer peripheral portion and the small-radius outer peripheral portion of the third eccentric cam, and the large-radius outer peripheral portion of the second eccentric cam substantially contacts another of the large-radius outer peripheral portion and the small-radius outer peripheral portion of the third eccentric cam, the tray moves away from the feed roller so as to be unable to convey the sheet, and in a second case in which the small-radius outer peripheral portion of the first eccentric cam substantially contacts the small-radius outer peripheral portion of the third eccentric cam, and the small-radius outer peripheral portion of the third eccentric cam substantially contacts the small-radius outer peripheral portion of the second eccentric cam, the tray approaches the feed roller so as to be able to convey the sheet.

In accordance with still yet another aspect of the present invention, there is provided an image forming device having a sheet supplying device, the sheet supplying device comprising: a base; a tray on which a stack of sheet-shaped recording media can be placed, the tray being able to be raised and lowered with respect to the base; a feed roller provided rotatably at the base and positioned above the tray, and when the feed roller rotates while frictionally engaging with a topmost recording medium of the stack of recording media, the feed roller can convey the recording medium; a driving mechanism able to drive the feed roller to rotate; an urging member urging the tray toward the feed roller; a first eccentric cam provided rotatably at the base, and including a large-radius outer peripheral portion whose radius is large and a small-radius outer peripheral portion whose radius is small, the first eccentric cam rotating interlockingly with rotation of the feed roller; and a second eccentric cam provided rotatably at the tray, and including a large-radius outer peripheral portion whose radius is large and a small-radius outer peripheral portion whose radius is small, the second eccentric cam able to engage with the first eccentric cam, wherein, when the respective small-radius outer peripheral portions of the first eccentric cam and the second eccentric cam substantially contact one another, the tray approaches the feed roller so as to be able to convey the recording medium, and when the respective large-radius outer peripheral portions of the first eccentric cam and the second eccentric cam substantially contact one another, the tray moves away from the feed roller so as to be unable to convey the recording medium.

Other objects, features and advantages of the present invention will be apparent to those skilled in the art from the explanation of the preferred embodiments of the present invention illustrated in the appended drawings, and from the appended claims.

BRIEF DESCRIPTION OF THE DRAWINGS

Preferred embodiments of the present invention will be described in detail based on the following figures, wherein.

DETAILED DESCRIPTION OF THE INVENTION

FIRST EMBODIMENT

Hereinafter, a sheet supplying device of a first embodiment of the present invention will be described in detail with reference to FIGS. 1 through 7.

Figure 7:
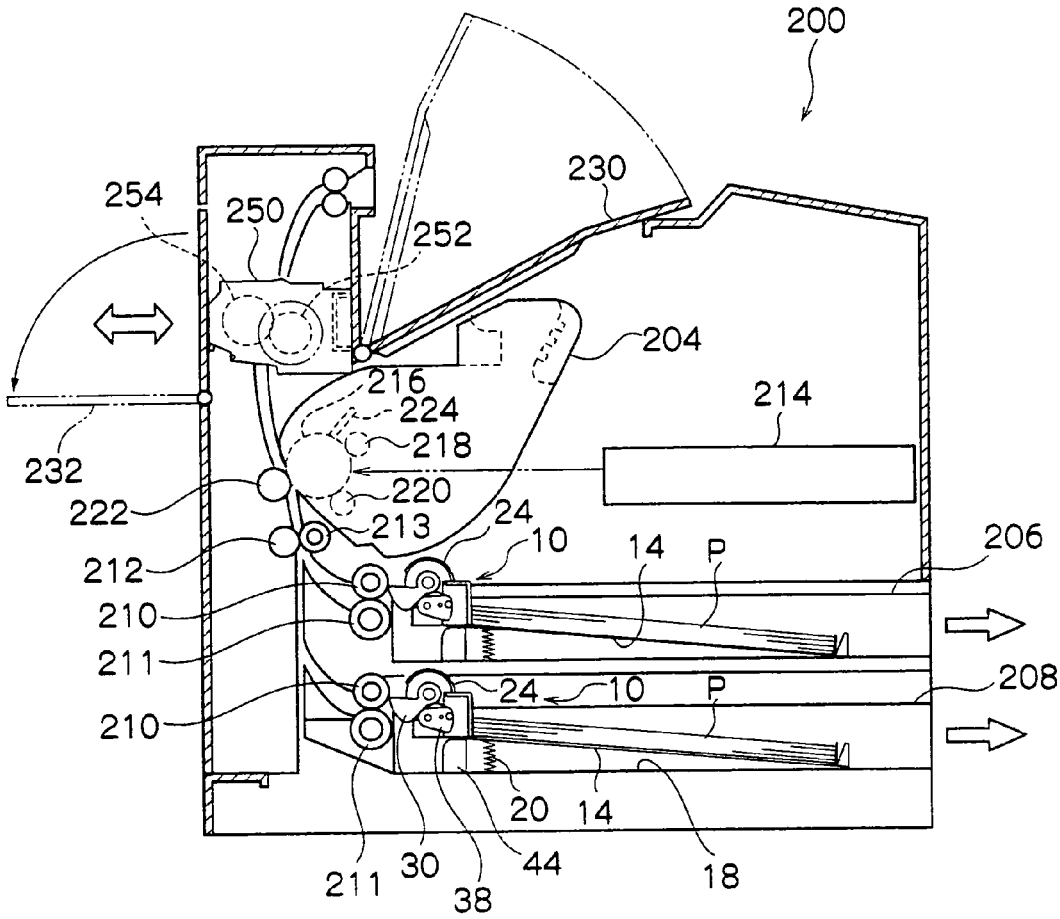
FIG. 7 is a schematic structural diagram showing an example of an image forming device into which the sheet supplying device of the first embodiment is incorporated.

As shown in FIG. 7, a sheet supplying device 10 is provided at the lower portion of an image forming device 200, and successively feeds, one-by-one, recording media (sheets) P to a process cartridge 204 structuring an image forming section.

Figure 1:
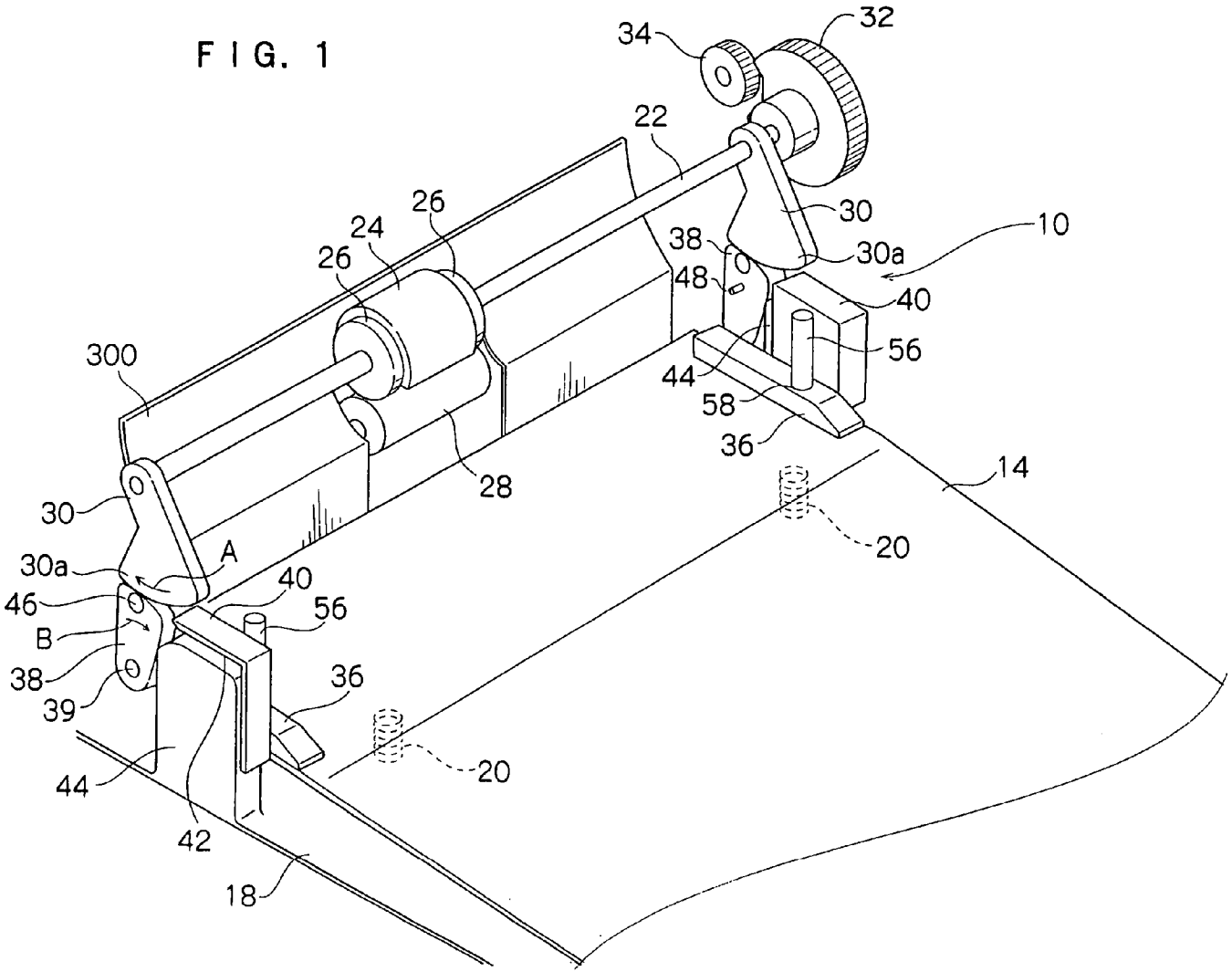
FIG. 1 is a perspective view showing a sheet supplying device relating to a first embodiment of the present invention.

As shown in FIGS. 1 and 7, presser plates 14, on which the sheets P are stacked, are provided in the sheet supplying device 10. Insertion holes 58, through which pass poles 56 which stand upright at a base 18, are formed at both end portions of the presser plate 14 in a direction orthogonal to the sheet feeding direction. The presser plate 14 can move upward and downward while being guided by the poles 56. The presser plate 14 is urged upward by coil springs 20 provided at the base 18.

A supporting shaft 22 is disposed above the presser plate 14. The supporting shaft 22 is supported so as to be freely rotatable with respect to a main body frame of the image forming device 200. A half-moon-shaped feed roller 24, which feeds the sheets P (not shown in FIG. 1) which are stacked on the presser plate 14, is fixed to the supporting shaft 22. Core rollers 26, whose radii are somewhat smaller than the radius of the half-moon-shaped feed roller 24, are fixed to the both sides of the feed roller 24.

As shown in FIG. 1, a separating roller 28 is rotatably supported at the portion of a main body frame 300 opposing the feed roller 24 and the core rollers 26. The separating roller 28 is formed as a member whose surface has great frictional force. Due to the rotation of the supporting shaft 22, the core rollers 26 rotate in a state of abutting the separating roller 28. Further, the peripheral surface of the feed roller 24 can feed the topmost sheet P out by rotating while abutting the stack of sheets P stacked on the presser plate 14.

First cams 30 are fixed to both end portions of the supporting shaft 22. The first cams 30 have arc-shaped portions 30*a* which are fan-shaped and whose eccentric radii are larger than the radius of the feed roller 24.

A driven gear 32 is mounted to one end portion of the supporting shaft 22. A portion of the outer periphery of the driven gear 32 is toothless. A driving gear 34, which is driven to rotate by an unillustrated motor, can mesh with the driven gear 32. When the sheets P are to be fed, the driving force of the driving gear 34 is transmitted to the driven gear 32 at a predetermined timing by an unillustrated control device, such that the supporting shaft 22, the feed roller 24, the core rollers 26 and the first cams 30 rotate one time in the direction of arrow A (see FIGS. 3A through 3D).

As shown in FIG. 1, flanges 36 which project upward are formed at positions of the both sides of the presser plate 14 which positions oppose the first cams 30. Second cams 38 are rotatably supported by rotating shafts 39 at the flanges 36. First cam followers 40, which can abut the first cams 30, are provided so as to project out at end sides of the flanges 36, at the sides of the second cams 38 which sides are opposite the sides in the feeding direction. Concave portions 42 are formed beneath the first cam followers 40. The second cams 38 can enter into the concave portions 42 when the second cams 38 are rotating.

Figure 3A:
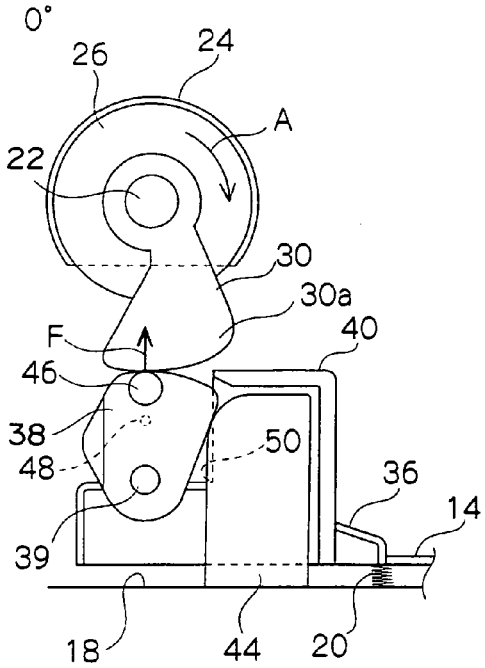
FIGS. 3A through 3D are side views showing workings of the sheet supplying device of the first embodiment.

Second cam followers 44 are mounted to the base 18 beneath the concave portions 42 of the first cam followers 40. As shown in FIG. 3A, due to the second cams 38 abutting the second cam followers 44, the second cams 38 are held in a state (posture) in the direction of abutting the first cams 30. Rollers 46 are provided at the regions of the second cams 38 which regions abut the first cams 30. Convex and concave portions may be formed in the peripheral surfaces of the rollers 46 in order to prevent slippage between the rollers 46 and the first cams 30. As shown in FIG. 3A, when the arc-shaped portions 30*a* of the first cams 30, whose eccentric radii are large, abut the portions of the second cams 38 where the eccentric radii are large, the presser plate 14 is pushed downward to its lowermost position.

Because the coil springs 20 push the presser plate 14 upward, the second cams 38 abut the second cam followers 44 in addition to abutting the first cams 30.

Figure 3B:
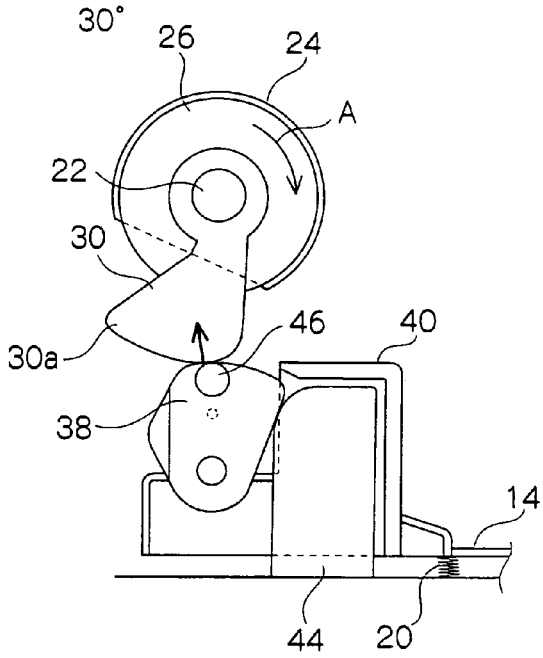
Figure 3C:
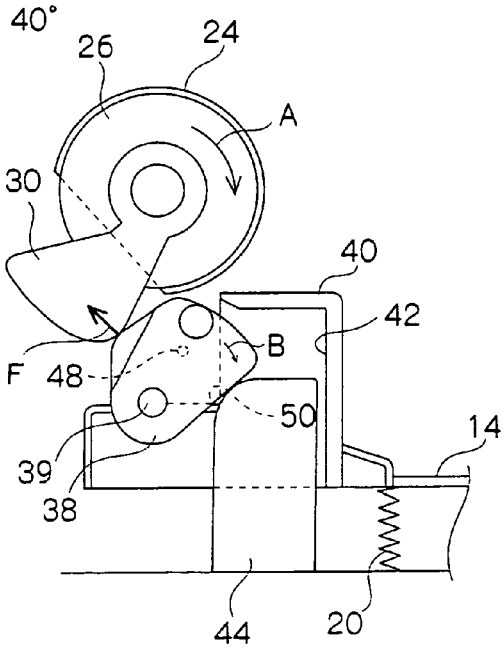

When the first cams 30 rotate in the direction of arrow A, components of force which rotate the second cams 38 in the opposite direction so as to counteract this, are applied to the second cams 38 so that the second cams 38 rotate in the direction of arrow B (see FIG. 3C).

Figure 2:
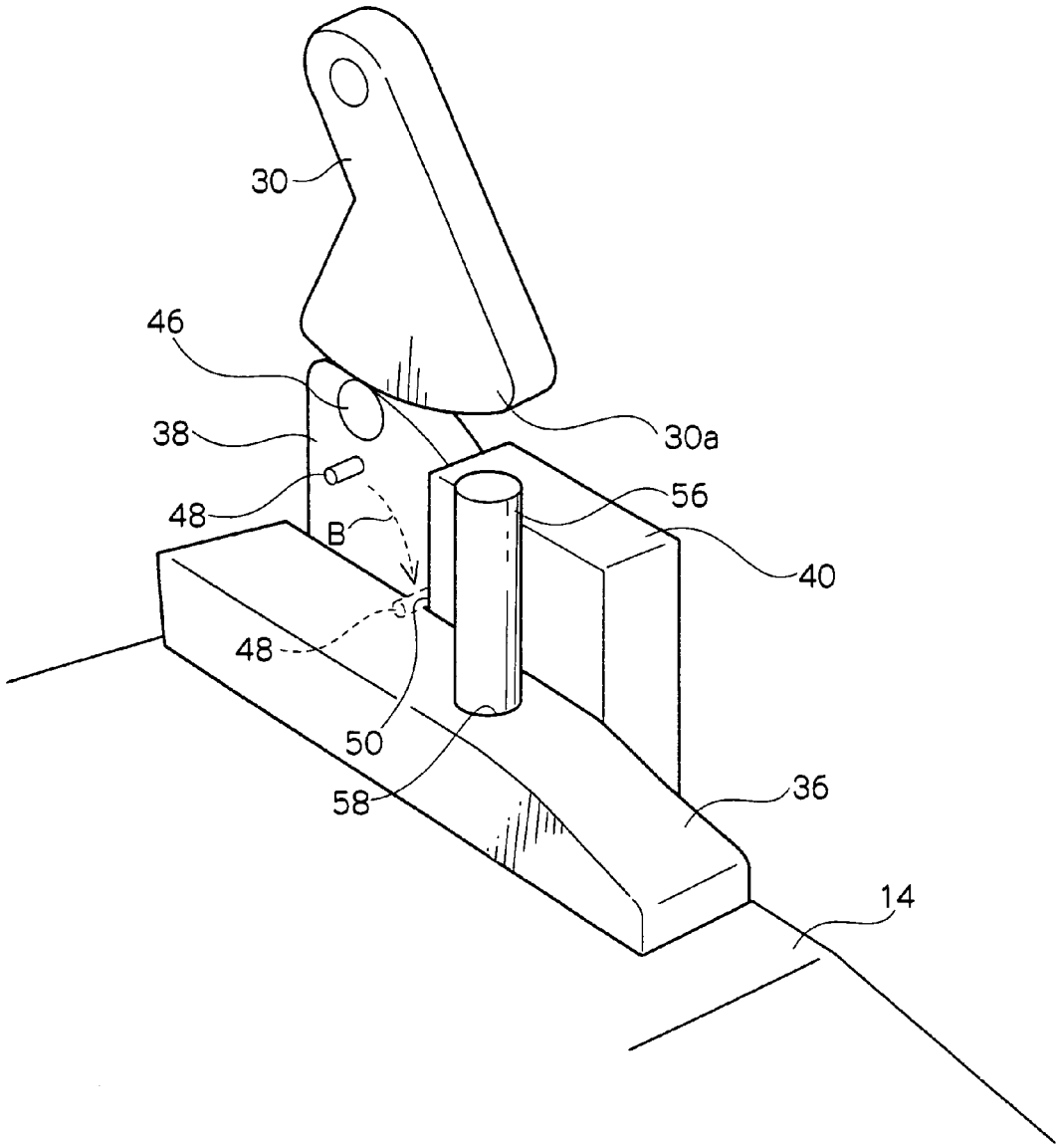
FIG. 2 is a perspective view showing a receiving portion and a pin which restrict rotation of a second cam of the sheet supplying device of the first embodiment.

As shown in FIG. 2, pins 48 project at the inner sides (the feed roller 24 sides) of the second cams 38. L-shaped receiving portions 50, which are structured by the flanges 36 and the first cam followers 40, are provided at the presser plate 14. When the second cams 38 rotate in the direction of arrow B, the pins 48 are received in the receiving portions 50, and rotation of the second cams 38 is restricted due to the self-weights thereof.

In this sheet supplying device 10, the number of sheets P which can be stacked on the presser plate 14 (the number of sheets which can be accommodated) is about 250 sheets for regular paper, and about 200 sheets for thick paper.

Hereinafter, operation of the sheet supplying device 10 will be described with reference to FIGS. 3A through 6C.

As shown in FIG. 3A, when the sheets P are not being fed, the arc-shaped portions 30*a* of the first cams 30 abut the portions of the second cams 38 where the eccentric radii are large, so as to push the presser plate 14 downward in the direction of resisting the urging forces of the coil springs 20. Pressing forces F in the direction of the arrow and due to the urging forces of the coil springs 20 are applied to the first cams 30. At this time, the presser plate 14 is positioned at its lowermost position, and the sheets P (not illustrated) stacked on the presser plate 14 are set apart from the feed roller 24.

As shown in FIG. 3B, when the first cams 30 rotate in the direction of arrow A due to the rotation of the supporting shaft 22, components of force in the direction opposite the rotating direction are applied to the second cams 38 which are abutting the first cams 30, and the second cams 38 rotate in the direction of arrow B while abutting the second cam followers 44. The rollers 46 of the second cams 38 are abutting the first cams 30, and the first cams 30 rotate smoothly due to the rollers 46.

As the second cams 38 rotate, the eccentric radii of the abutting regions thereof become shorter, and the presser plate 14 is pushed upward by the urging forces of the coil springs 20. Due to the rotation of the supporting shaft 22, the feed roller 24 and the core rollers 26 as well rotate in the direction of arrow A.

As shown in FIG. 3C, when the first cams 30 rotate 40° in the direction of arrow A, the second cams 38 rotate in the direction of arrow B while abutting the second cam followers 44, and the presser plate 14 rises up smoothly. At this time, the second cams 38 enter into the concave portions 42 of the first cam followers 40 while rotating.

Figure 3D:
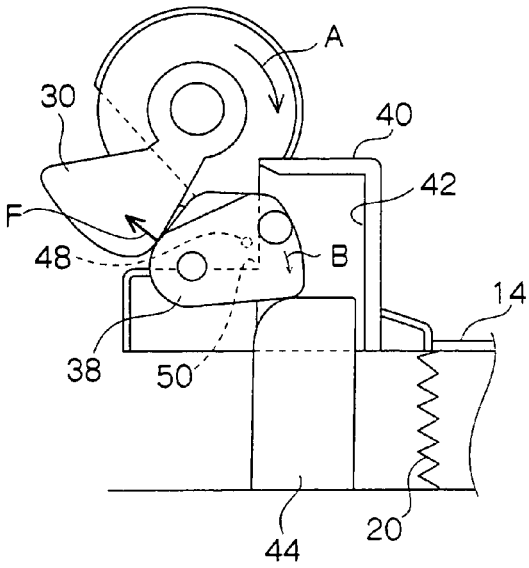

As shown in FIG. 3D, when the first cams 30 rotate 42.5° in the direction of arrow A, the second cams 38 rotate further in the direction of arrow B while abutting the top portions of the second cam followers 44, and the presser plate 14 is raised upward by the urging forces of the coil springs 20. When the second cams 38 rotate further in the direction of arrow B and the pins 48 of the second cams 38 engage with the receiving portions 50, further rotation of the second cams 38 is impeded.

Figure 4A:
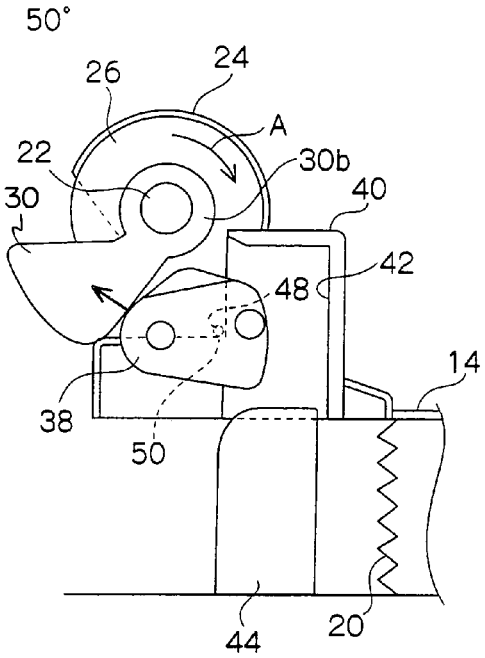
FIGS. 4A through 4D are side views showing other workings of the sheet supplying device of the first embodiment.

As shown in FIG. 4A, when the first cams 30 rotate 50° in the direction of arrow A, the angular positions of the second cams 38 do not change because the pins 48 are engaged with the receiving portions 50. Accordingly, the second cams 38 come away from the second cam followers 44. The presser plate 14 rises further due to the abutment of the first cams 30 and the second cams 38. Then, due to the rotation of the supporting shaft 22, the feed roller 24 and the core rollers 26 also rotate further in the direction of arrow A.

The presser plate 14 rises until the topmost portion of the stack of sheets P stacked on the presser plate 14 abuts the feed roller 24. Then, the stack of sheets P abuts/engages with the feed roller 24, and due to the feed roller 24 rotating while abutting the topmost sheet P, the sheet P is fed out. At the conveying direction downstream side of the sheet P, the reverse surface side of the sheet P contacts the separating roller 28 at a predetermined pressure. Due to the friction between the sheet P and the separating roller 28, feeding of the sheets P in an overlapping manner is prevented, and a single sheet P is conveyed.

Figure 4B:
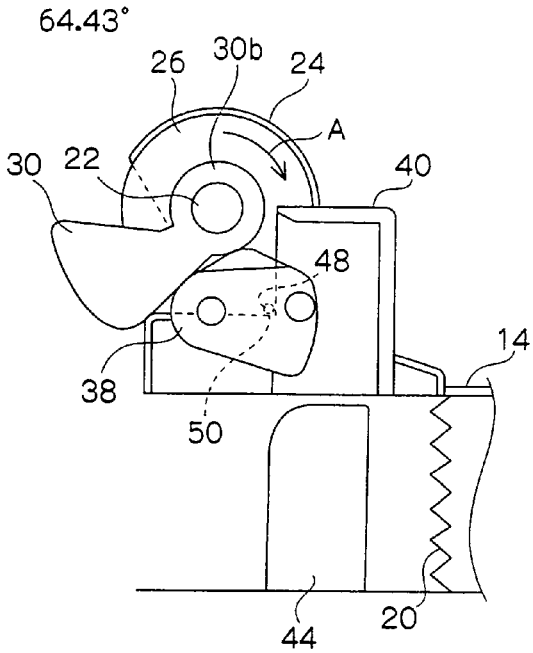

When a small number of the stacked sheets is conveyed, as shown in FIG. 4B, when the first cams 30 rotate in the direction of arrow A by 64.43°, the second cams 38 abut bearing portions 30*b* of the first cams 30, and the presser plate 14 reaches it uppermost position.

Figure 4C:
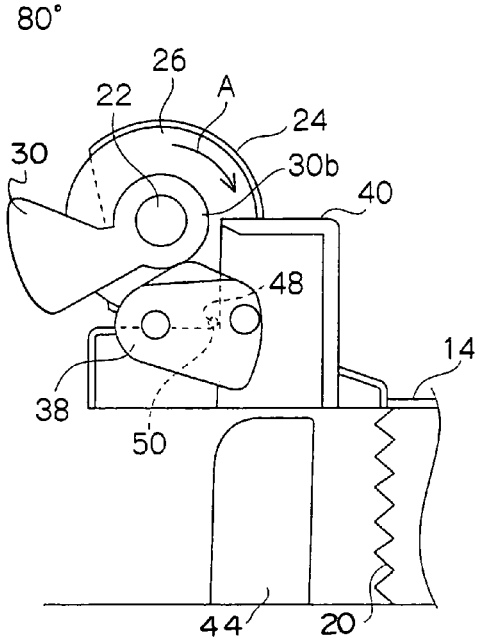
Figure 4D:
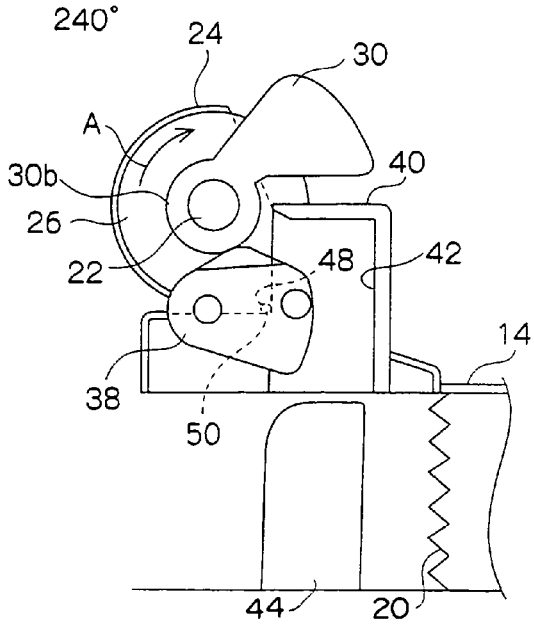

When the presser plate 14 is at its uppermost position, the first cam followers 40 provided at the presser plate 14 are positioned rearward of the supporting shaft 22 (i.e., at the side opposite the feeding direction side of the supporting shaft 22), such that the first cam followers 40 are prevented from interfering with the supporting shaft 22. Thereafter, as shown in FIGS. 4C and 4D, when the first cams 30 rotate in the direction of arrow A, the second cams 38 slidingly contact the bearing portions 30*b* of the first cams 30, and the presser plate 14 is held at its uppermost position.

Figure 5A:
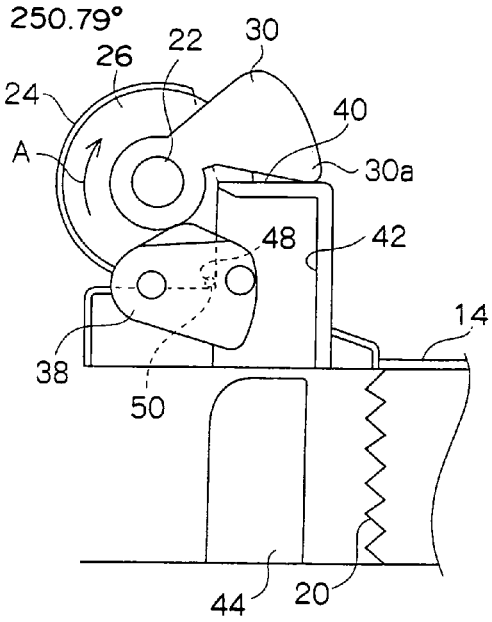
FIGS. 5A through 5D are side views showing yet other workings of the sheet supplying device of the first embodiment.

As shown in FIG. 5A, when the first cams 30 rotate 250.79° in the direction of arrow A, due to the distal ends of the arc-shaped portions 30*a* abutting and pressing the first cam followers 40, the presser plate 14 is pushed in the direction against the urging forces of the coil springs 20 (i.e., is pushed downward).

Figure 5B:
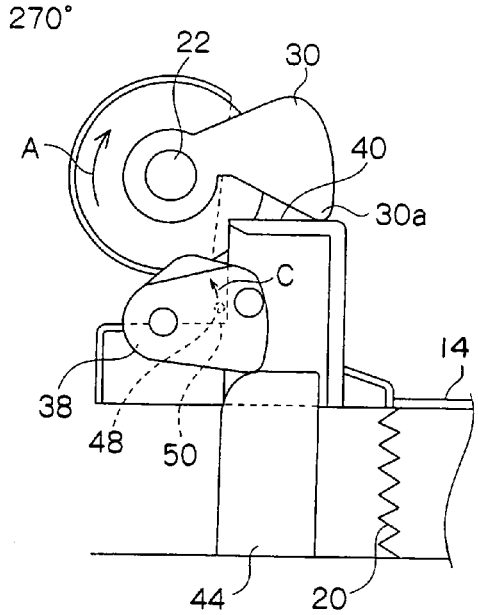

As shown in FIG. 5B, when the first cams 30 rotate 270° in the direction of arrow A, the second cams 38 abut the second cam followers 44 due to the lowering of the presser plate 14. Then, the pins 48 of the second cams 38 separate from the receiving portions 50, and the second cams 38 rotate in the direction of arrow C while abutting the second cam followers 44.

Figure 5C:
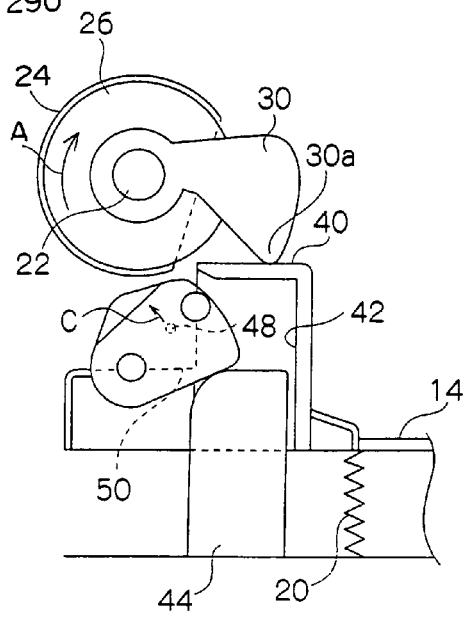

As shown in FIG. 5C, when the first cams 30 rotate 290° in the direction of arrow A, due to the arc-shaped portions 30*a* pushing the first cam followers 40, the presser plate 14 is lowered, and the second cams 38 rotate in the direction of arrow C by abutting the second cam followers 44.

Figure 5D:
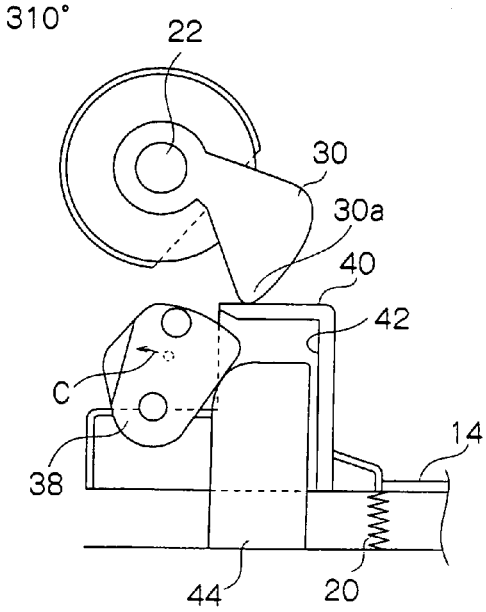
Figure 6A:
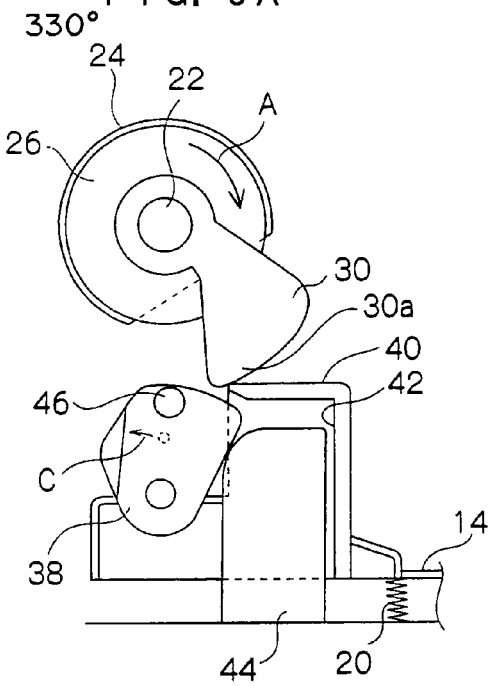
FIGS. 6A through 6C are side views showing still yet other workings of the sheet supplying device of the first embodiment.

As shown in FIGS. 5D and 6A, when the first cams 30 rotate further, the arc-shaped portions 30*a* press the presser plate 14 downward while the arc-shaped portions 30*a* slide along the first cam followers 40, and the second cams 38 rotate further in the direction of arrow C by abutting the second cam followers 44.

Figure 6B:
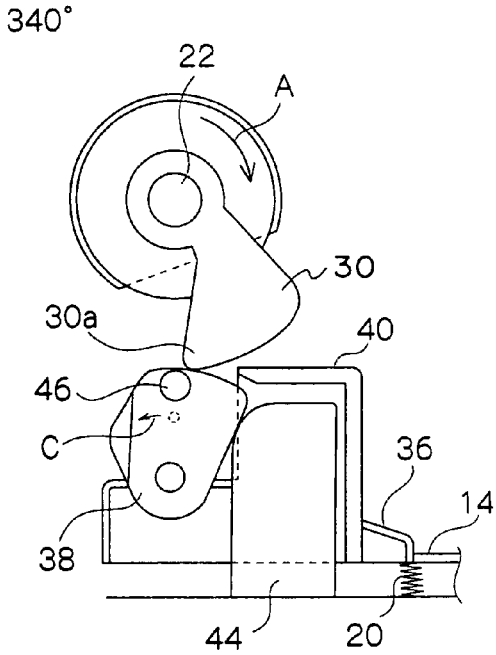

As shown in FIG. 6B, when the first cams 30 rotate 340° in the direction of arrow A, the arc-shaped portions 30*a* move away from the first cam followers 40 and abut the second cams 38.

Figure 6C:
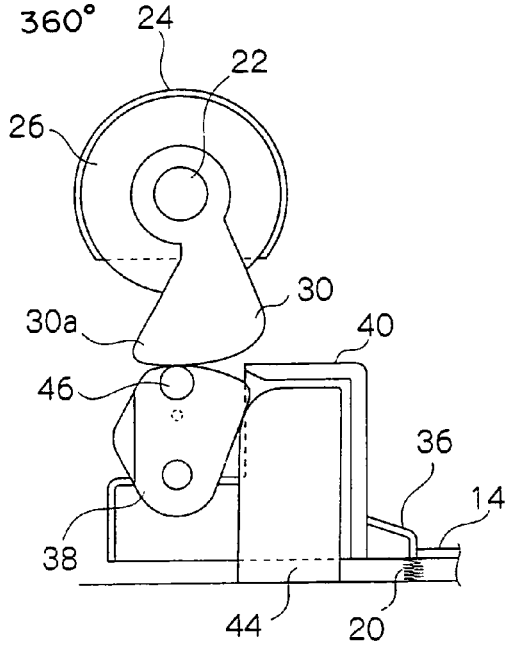

As shown in FIG. 6C, due to the first cams 30 rotating 360° in the direction of arrow A (i.e., due to the first cams 30 rotating one time), while the first cams 30 and the rollers 46 abut one another, the second cams 38 are rotated to their initial positions, and the presser plate 14 is pushed downward to its lowermost position.

In the present sheet supplying device 10, by rotating the first cams 30 and the second cams 38 respectively, the presser plate 14 is raised and lowered. Therefore, the stroke of the presser plate 14 can be made to be large, and the first cam followers 40 and the supporting shaft 22 do not interfere with one another when the presser plate 14 is at its uppermost position. Therefore, even if the first cams 30 are made to be small, the sheet P accommodating capacity can be increased, and the sheet supplying device 10 can be made to be compact.

SECOND EMBODIMENT

Hereinafter, a second embodiment of a sheet supplying device relating to the present invention will be briefly described with reference to FIGS. 8A and 8B.

Note that the same reference numerals are applied to members and portions which were described in the first embodiment, and repeat description will be appropriately omitted.

Figure 8A:
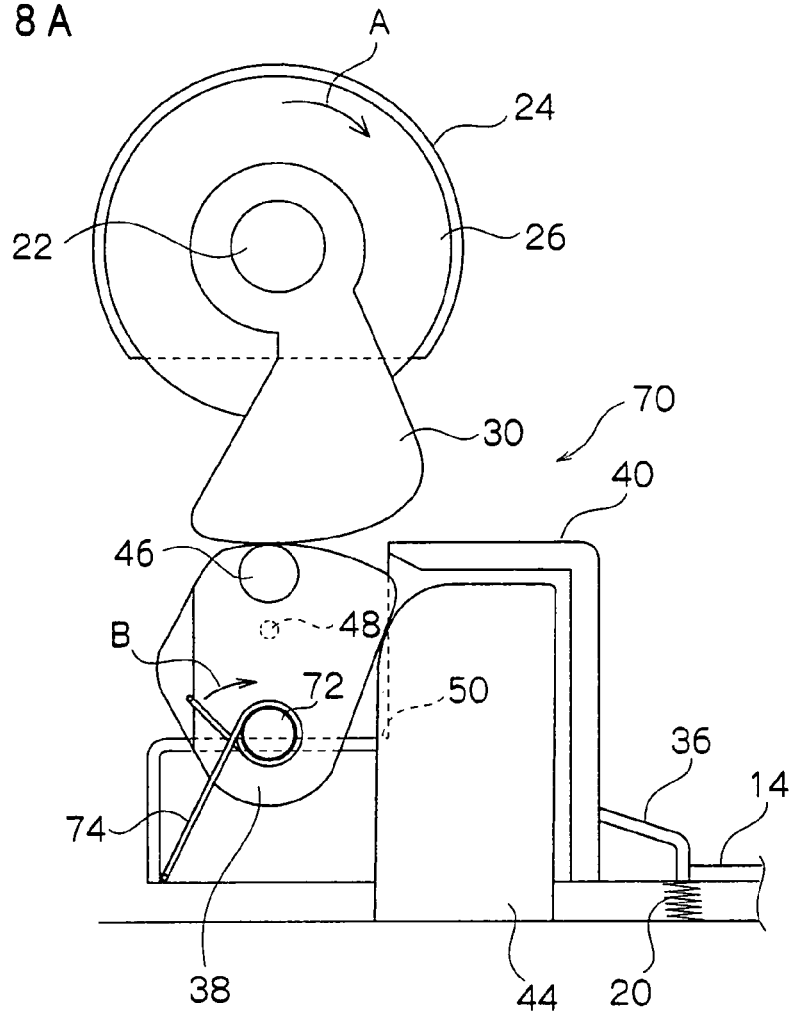
FIGS. 8A and 8B are respectively a side view and a perspective view of a sheet supplying device relating to a second embodiment of the present invention.
Figure 8B:
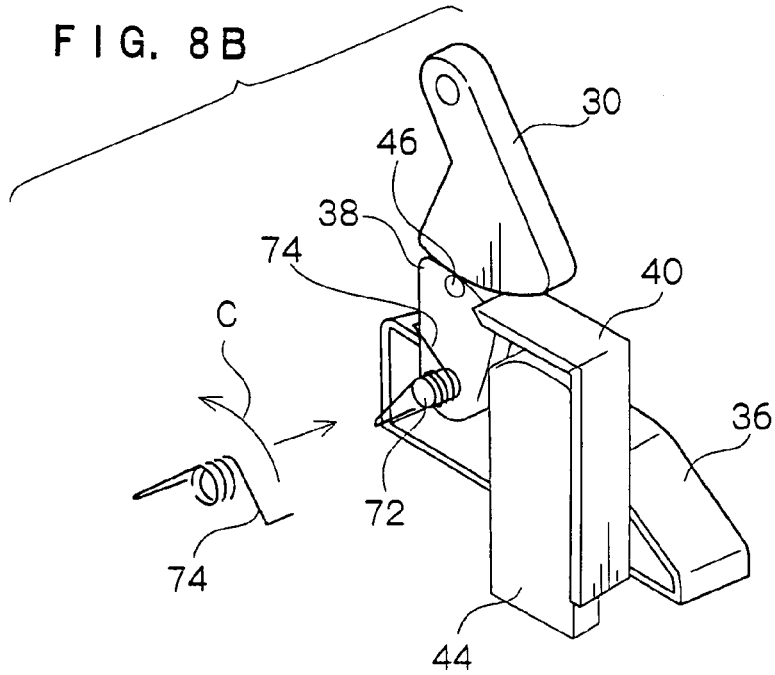

In a sheet supplying device 70 shown in FIGS. 8A and 8B, springs 74, which urge the second cams 38 in the direction of arrow B, are wound around rotating shafts 72 of the second cams 38. Ones of ends of the springs 74 are attached to the second cams 38, whereas the other ends are attached to the flanges 36.

In this way, as the presser plate 14 rises, the second cams 38 rotate in the direction of arrow B in a state of abutting the second cam followers 44. On the other hand, when the presser plate 14 falls, the second cams 38 rotate in the direction resisting the urging forces of the springs 74 (i.e., in the direction of arrow C) due to the second cams 38 abutting the second cam followers 44.

In this way, by the simple structure of providing the springs 74 which urge the second cams 38, the behavior of the second cams 38 at times when the presser plate 14 is moving upward and downward can be stabilized.

THIRD EMBODIMENT

Hereinafter, a third embodiment of a sheet supplying device relating to the present invention will be described briefly with reference to FIGS. 9A, 9B, 10A, and 10B.

Note that the same reference numerals are applied to members and portions which were described in the first and second embodiments, and repeat description will be appropriately omitted.

Figure 9A:
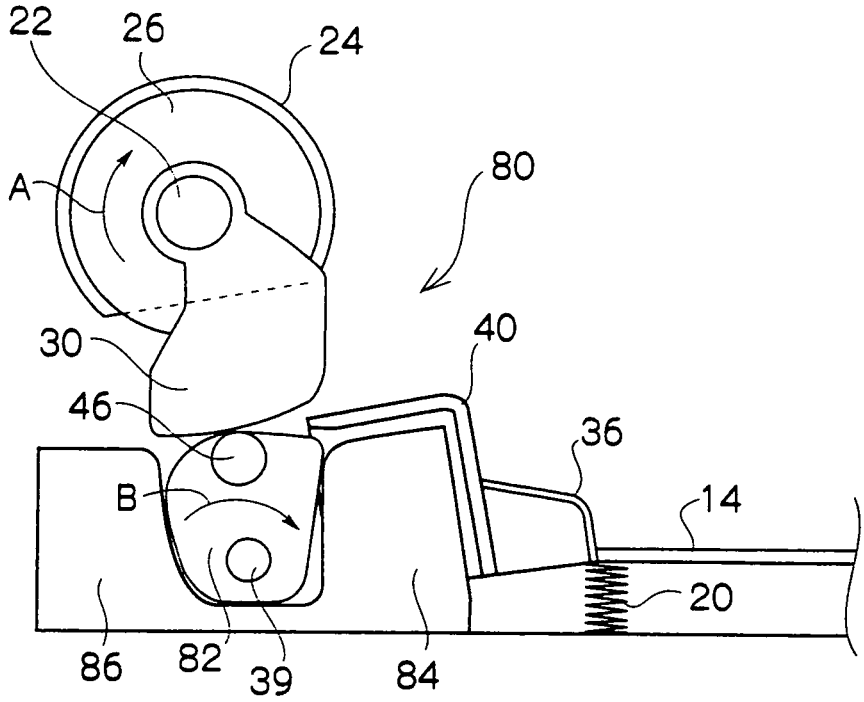
FIGS. 9A and 9B are side views showing workings of a sheet supplying device relating to a third embodiment of the present invention.
Figure 9B:
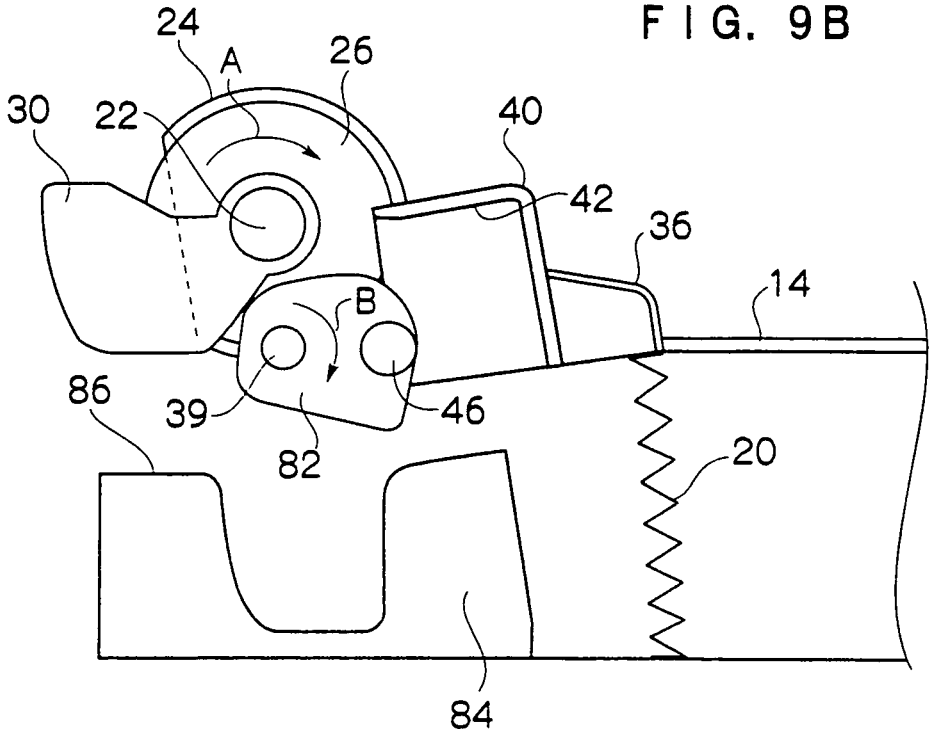

In a sheet supplying device 80 shown in FIG. 9B, second cams 82 are rotatably supported at the presser plate 14 via the rotating shafts 39. Springs such as in the second embodiment are not provided at the second cams 82.

Second cam followers 84, which abut the second cams 82 and rotate the second cams 82 in a given direction, are provided beneath the concave portions 42 of the first cam followers 40.

Third cam followers 86 are provided at positions which oppose the second cam followers 84, with the second cams 82 therebetween. The third cam followers 86 restrict rotation of the second cams 82 in the direction of moving away from the second cam followers 84.

The surfaces of the third cam followers 86 which surfaces abut the second cams 82 have configurations which curve along the loci of rotation of the second cams 82. The third cam followers 86 can make the second cams 82 rotate continuously in the given direction.

The second cam follower 84 and the third cam follower 86 are formed as an integral part and mounted to the base (see FIG. 1).

Next, operation of the present sheet supplying device 80 will be described.

As shown in FIG. 9A, the second cams 82 abut the second cam followers 84 and the third cam followers 86 at the both sides. The portions of the second cams 82 where the eccentric radii are large abut the portions of the first cams 30 where the eccentric radii are large. At this time, the presser plate 14 is positioned at its lowermost position against the urging forces of the springs 20.

When the first cams 30 rotate in the direction of arrow A due to the rotation of the supporting shaft 22, components of force in the direction opposite to the direction of rotation of the first cams are applied to the second cams 82. The second cams 82 rotate in the direction of arrow B while abutting the second cam followers 84. At this time, because the abutment surfaces of the third cam followers 86 are formed in configurations which curve along the loci of rotation of the second cams 82, the second cams 82 rotate continuously without joggling. As the second cams 82 rotate, the presser plate 14 rises smoothly.

As shown in FIG. 9B, due to the rising of the presser plate 14, the second cams 82 separate from the second cam followers 84. At this time, the rotation of the second cams 82 is restricted by the pins and the receiving portions (which are not illustrated) (see FIG. 2). Then, due to the rotation of the first cams 30, the presser plate 14 rises up to its uppermost position.

Figure 10A:
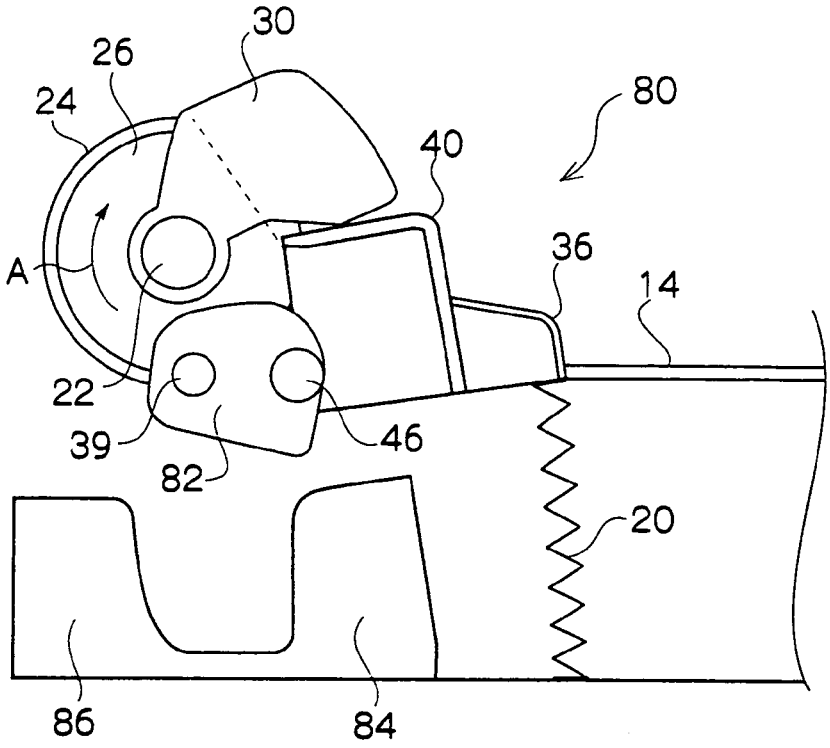
FIGS. 10A and 10B are side views showing workings of the sheet supplying device of the third embodiment.

As shown in FIG. 10A, when the first cams 30 rotate further in the direction of arrow A, the first cams 30 abut the first cam followers 40 and push the presser plate 14 downward. Due to the lowering of the presser plate 14, the second cams 82 abut the second cam followers 84, and the second cams 82 rotate in the direction of arrow C (see FIG. 10B).

Figure 10B:
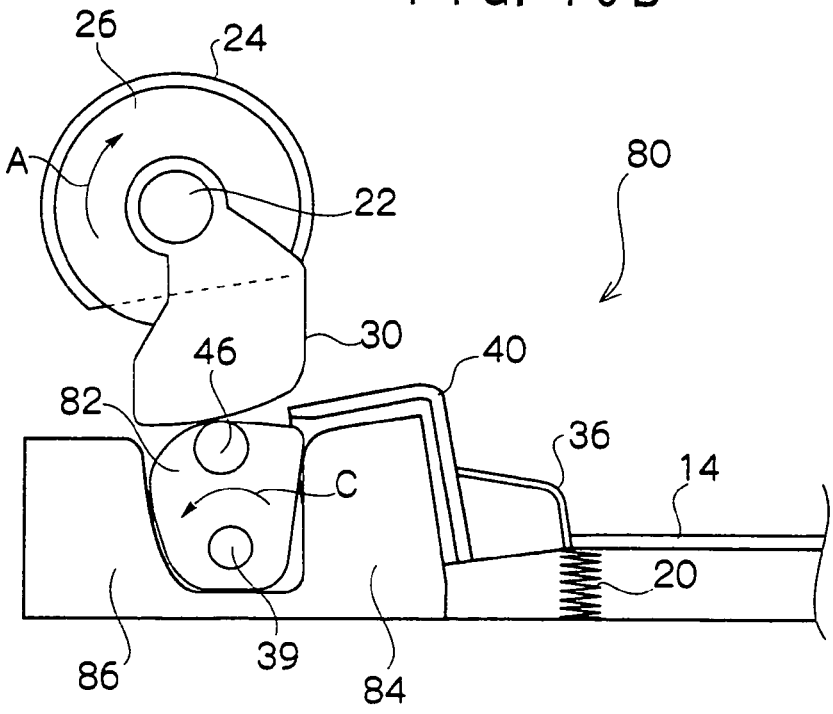

As shown in FIG. 10B, as the presser plate 14 is lowered, the second cams 82 abut the third cam followers 86, and rotation of the second cams 82 in the direction of arrow C is restricted. Due to the first cams 30 separating from the first cam followers 40 and abutting the second cams 82, the presser plate 14 is lowered to its lowermost position.

In this sheet supplying device 80, the third cam followers 86 are disposed at positions opposing the second cam followers 84 with the second cams 82 therebetween. Therefore, rotation of the second cams 82 in the direction of moving away from the second cam followers 84 can be restricted. As a result, the second cams 82 rotate so as to smoothly follow the second cam followers 84. Due to such a structure, even if the springs 74 (see FIGS. 8A, 8B) of the second embodiment are not provided, similar effects can be achieved.

Note that, instead of mounting the second cam follower 84 and the third cam follower 86 as an integral part to the base (see FIG. 1), the second cam follower and the third cam follower may be structured as separate parts, and the third cam follower may be mounted to the presser plate 14.

FOURTH EMBODIMENT

Hereinafter, a fourth embodiment of a sheet supplying device relating to the present invention will be described in detail with reference to FIGS. 11 through 13C.

Note that the same reference numerals are applied to members and portions which were described in the first embodiment, and repeat description will be appropriately omitted.

Figure 11:
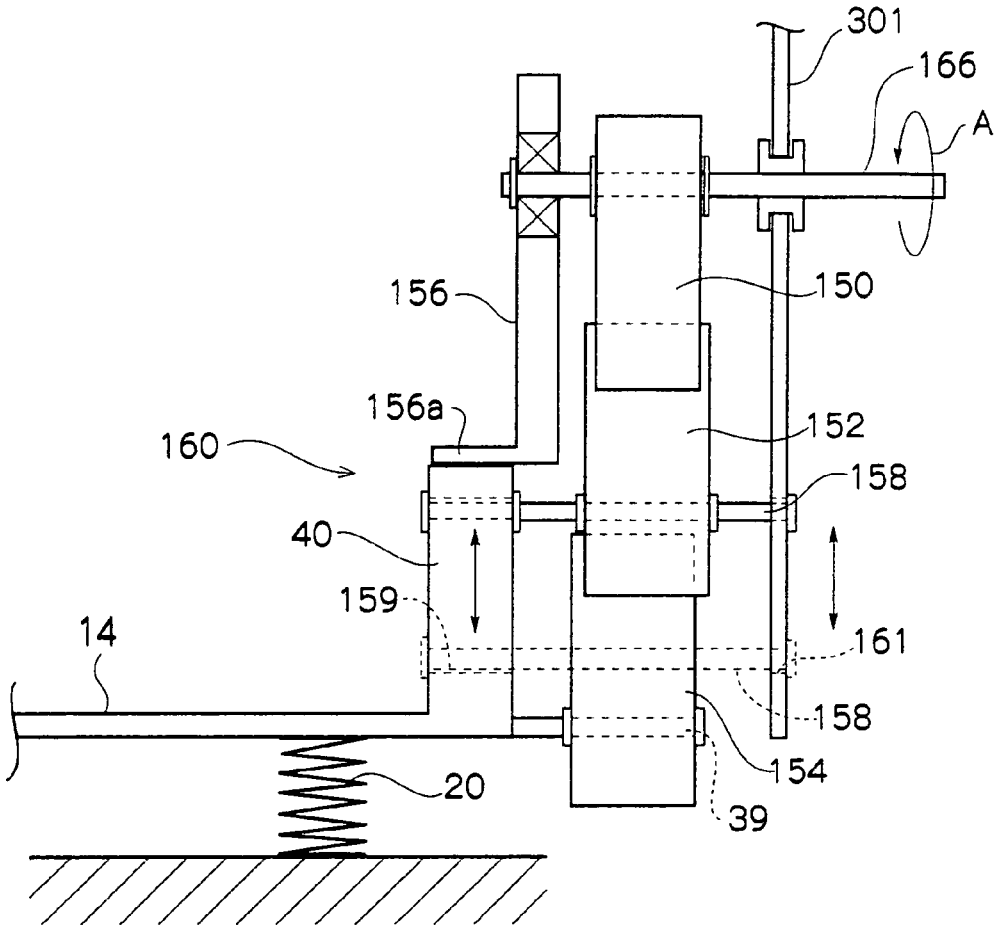
FIG. 11 is a plan view showing a sheet supplying device relating to a fourth embodiment of the present invention.
Figure 12A:
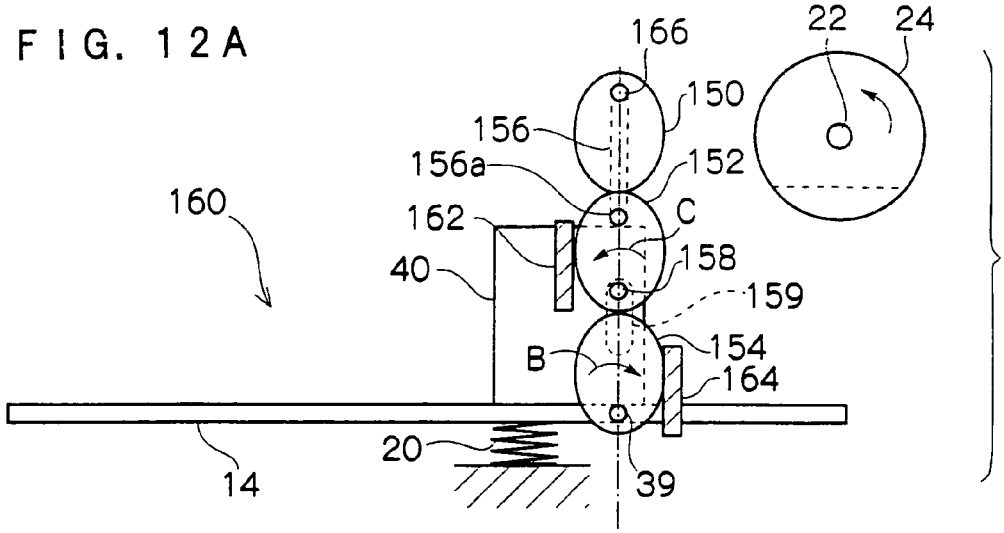
FIGS. 12A through 12C are side views showing workings of the sheet supplying device of the fourth embodiment.

As shown in FIGS. 11 and 12A, in a sheet supplying device 160, a supporting shaft 166 is rotatably provided at a main body frame 301. Oval first cams 150 and rod-shaped members 156, which are longer than the portions of the first cams 150 where the eccentric radii are large, are fixed to the supporting shaft 166. As shown in FIG. 11, the free end of the rod-shaped member 156 is bent inwardly and forms an abutment portion 156*a* which abuts the first cam follower 40 of the presser plate 14.

Oval second cams 154 are rotatably supported at the presser plate 14 by the rotating shafts 39. The second cams 154 abut second cam followers 164 which are mounted to the main body frame 301 (not shown in FIGS. 12A through 12C), and are urged in the direction of arrow B by unillustrated springs.

As shown in FIG. 11, long holes 159, 161 which extend in the vertical direction are formed in the first cam follower 40 and the main body frame 301. A rotating shaft 158 of an oval third cam 152 is slidable in the vertical direction along the long holes 159, 161. The third cams 152 can abut second cam followers 162 which are mounted to the main body frame 301 (not shown in FIGS. 12A through 12C). The third cams 152 are urged in the direction of arrow C by springs which are not shown.

The first cams 150 are driven to rotate in the direction of arrow A due to the rotation of the supporting shaft 166. The third cams 152 and the second cams 154 are driven cams which rotate following the rotation of the first cams 150.

As shown in FIG. 12A, the supporting shaft 166 of the first cams 150 and the rod-shaped members 156 is a different shaft than the supporting shaft 22 of the feed roller 24, and can be driven to rotate separately from the feed roller 24.

Next, operation of the present sheet feeding device 160 will be described with reference to FIGS. 12A through 12C and FIGS. 13A through 13C.

As shown in FIG. 12A, the presser plate 14 is pushed downward to its lowermost position due to respective portions of the first cams 150, the third cams 152, and the second cams 154, at which portions the eccentric radii are large, abutting one another and the abutment portions 156*a* of the rod-shaped members 156 abutting the first cam followers 40.

Figure 12B:
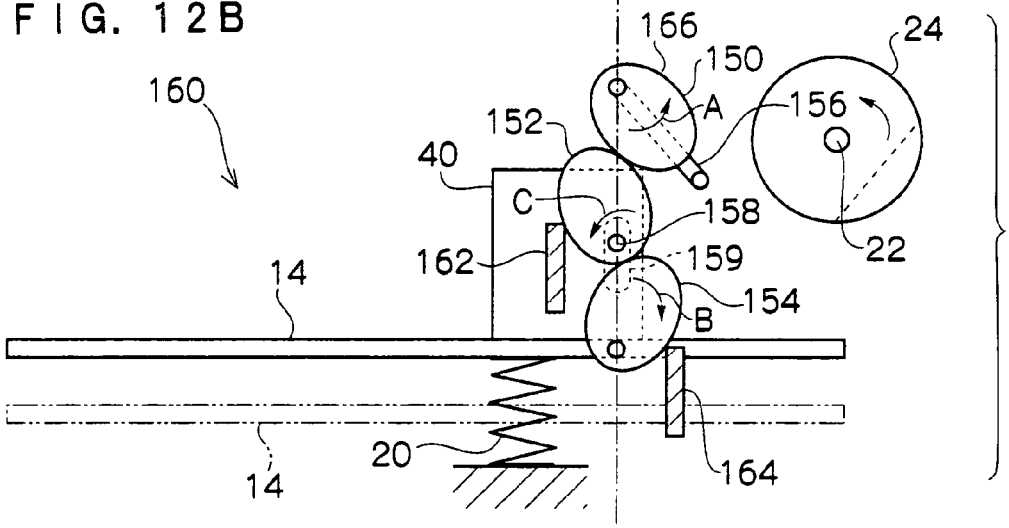

As shown in FIG. 12B, when the first cams 150 rotate in the direction of arrow A, accompanying this rotation, the rod-shaped members 156 also rotate, and the abutment portions 156*a* separate from the first cam followers 40. As the first cams 150 rotate, the third cams 152 rotate followingly in the direction of arrow C (which is the urging direction of the unillustrated springs) while abutting the second cam followers 162. As the third cams 152 rotate, the rotating shafts 158 begin to slide along the long holes 159.

As the third cams 152 rotate, the second cams 154 rotate in the urging direction of the unillustrated springs (the direction of arrow B) while abutting the second cam followers 164. Due to such rotation of the first cams 150 and the third cams 152 and the second cams 154, the presser plate 14 rises upward due to the urging forces of the springs 20.

Figure 12C:
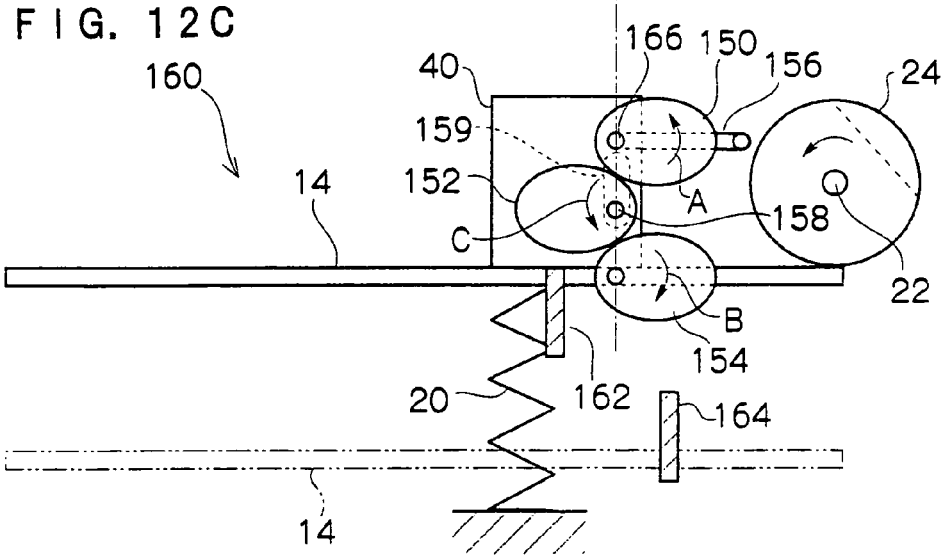

As shown in FIG. 12C, when the first cams 150 rotate further in the direction of arrow A, the third cams 152 rotate further in the direction of arrow C, and the rotating shafts 158 slide in the long holes 159. Accompanying this, the second cams 154 also rotate in the direction of arrow B. When the third cams 152 and the second cams 154 have respectively rotated 90°, rotation thereof is restricted due to the unillustrated pins and receiving portions.

Due to the portions of the first cams 150, the third cams 152, and the second cams 154, at which portions the eccentric radii are small, abutting one another, the presser plate 14 rises to its topmost position. At this time, the first cam followers 40 do not interfere with the abutment portions 156*a* of the rod-shaped members 156 and the supporting shaft 166 of the first cams 150. When the presser plate 14 is raised, the sheets P are supplied by the feed roller 24 (see FIG. 1).

Figure 13A:
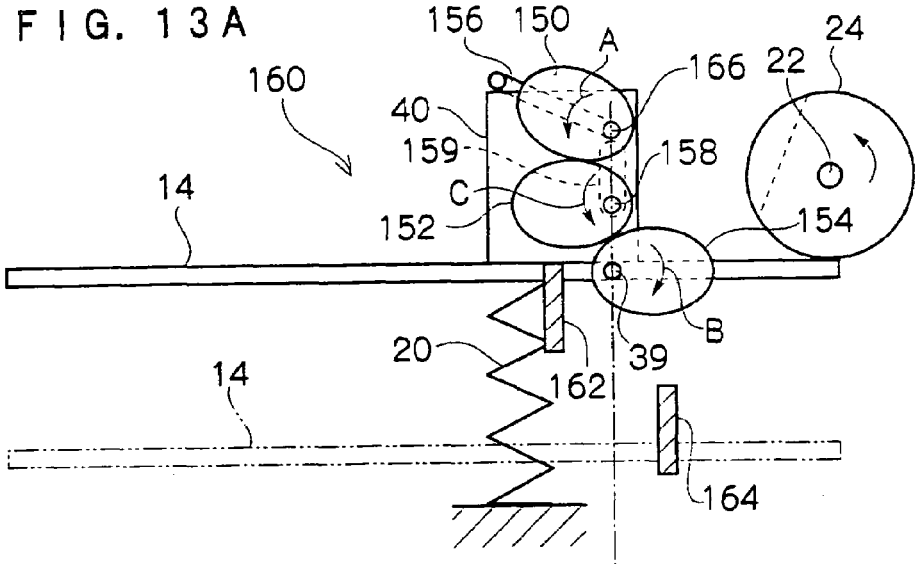
FIGS. 13A through 13C are side views showing other workings of the sheet supplying device of the fourth embodiment.

Thereafter, as shown in FIG. 13A, when the first cams 150 rotate in the direction of arrow A, the abutment portions 156*a* of the rod-shaped members 156 abut the first cam followers 40, and push the presser plate 14 downward against the urging forces of the springs 20.

Figure 13B:
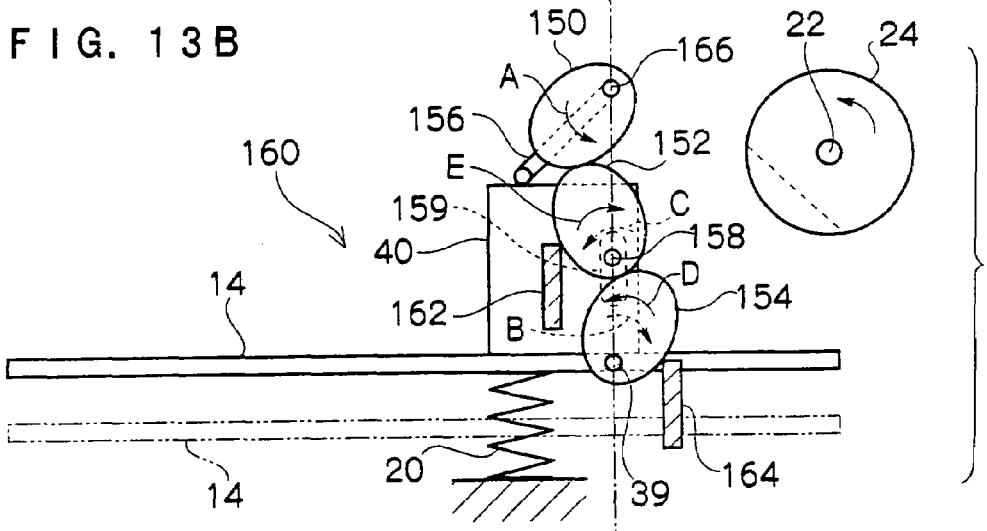

As shown in FIG. 13B, when the first cams 150 rotate further in the direction of arrow A, the first cams 150 abut the third cams 152, and the third cams 152 abut the second cam followers 162, and the third cams 152 rotate in the direction of arrow E which is opposite to the urging forces of the springs (not shown). Together therewith, the rotating shafts 158 of the third cams 152 are slid along the long holes 159. The second cams 154, which are abutting the third cams 152, abut the second cam followers 164 and rotate in the direction of arrow D which is opposite to the urging forces of the springs (not shown).

Figure 13C:
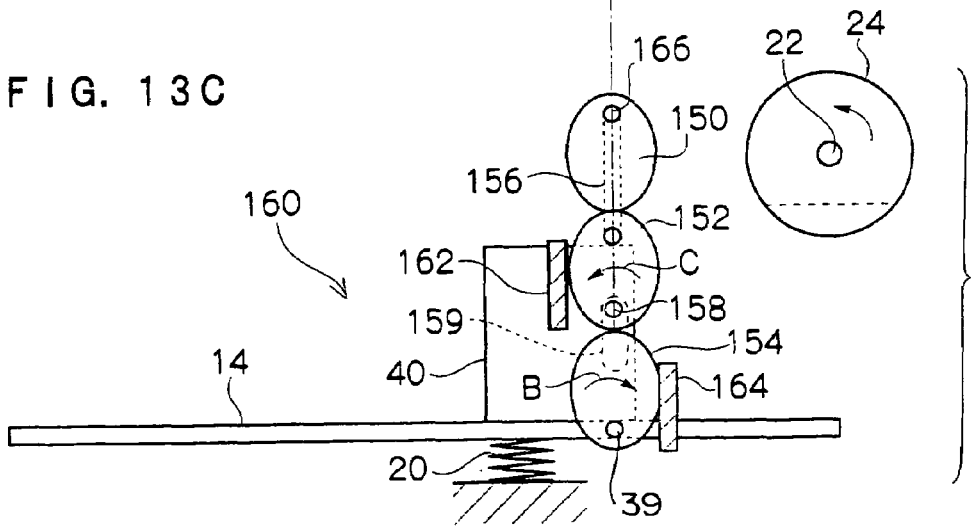

As shown in FIG. 13C, when the first cams 150 have rotated one time in the direction of arrow A, the rotating shafts 158 of the third cams 152 slide along the long holes 159, and the portions of the first cams 150, the third cams 152, and the second cams 154, at which portions the eccentric radii are large, abut one another. In this way, the presser plate 14 falls to its lowermost position.

In the present sheet supplying device 160, the presser plate 14 is raised and lowered by the combination of the three cams. Therefore, even if the eccentric radii of the respective cams 150, 152, 154 are not made to be large, the stroke of the presser plate 14 can be made to be large. Therefore, the sheet P accommodating capacity can be increased, and the device can be made compact overall.

FIFTH EMBODIMENT

Hereinafter, a fifth embodiment of a sheet supplying device relating to the present invention will be described in detail with reference to FIGS. 14A, 14B and FIGS. 15A, 15B.

Note that the same reference numerals are applied to members and portions which were described in the first and fourth embodiments, and repeat description will be appropriately omitted.

Figure 14A:
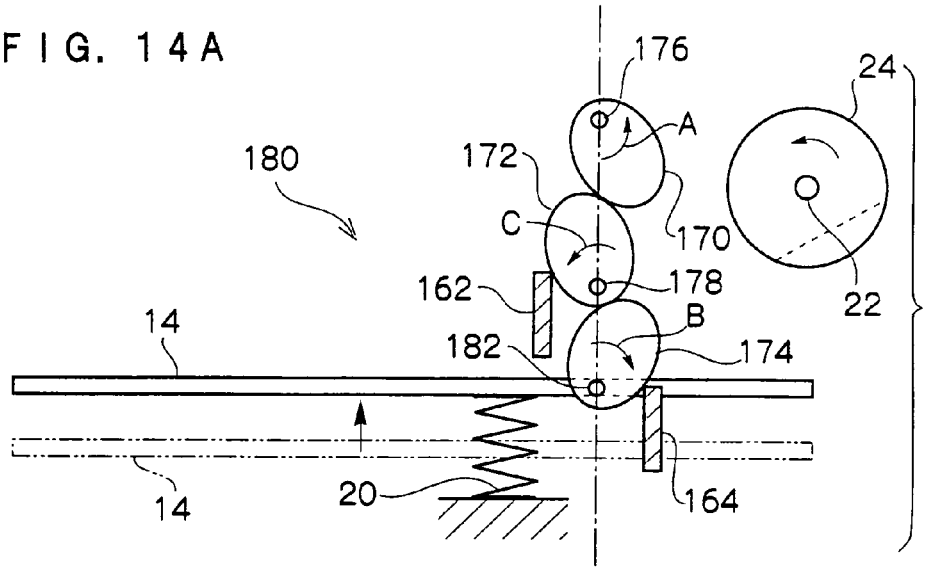
FIGS. 14A and 14B are side views showing workings of a sheet supplying device relating to a fifth embodiment of the present invention.

As shown in FIG. 14A, first cams 170 are provided so as to be rotatable by a supporting shaft 176 at the main body frame (not illustrated) of a sheet supplying device 180. The supporting shaft 176 is driven to rotate separately from the supporting shaft 22 of the feed roller 24. Second cams 174 are rotatably supported by rotating shafts 182 at the presser plate 14. The second cams 174 can abut the second cam followers 164. Springs for urging in a given direction are not provided at the second cams 174.

Third cams 172 are rotatably supported by rotating shafts 178 between the first cams 170 and the second cams 174, so as to abut the first cams 170 and the second cams 174. The rotating shafts 178 can slide vertically along long holes (not illustrated) provided in the main body frame. The third cams 172 can abut the second cam followers 162. Springs for urging in a given direction are not provided at the third cams 172.

The first cams 170 are driven to rotate 90° in opposite directions (the direction of arrow A and the direction of arrow D), due to the rotation of the supporting shaft 176. The third cams 172 and the second cams 174 are driven cams which rotate followingly accompanying the rotation of the first cams 170.

Next, operation of the present sheet supplying device 180 will be described.

The presser plate 14 is pushed downward to its lowermost position due to the respective portions of the first cams 170, the third cams 172, and the second cams 174, at which portions the eccentric radii are large, abutting one another.

As shown in FIG. 14A, when the first cams 170 rotate in the direction of arrow A, the third cams 172 rotate followingly in the direction of arrow C while abutting the second cam followers 162. Together therewith, the rotating shafts 178 start to slide. Due to the rotation of the third cams 172, the second cams 174 rotate followingly in the direction of arrow B while abutting the second cam followers 164. Due to the rotation of the first cams 170 and the third cams 172 and the second cams 174, the presser plate 14 rises upward due to the urging forces of the springs 20.

Figure 14B:
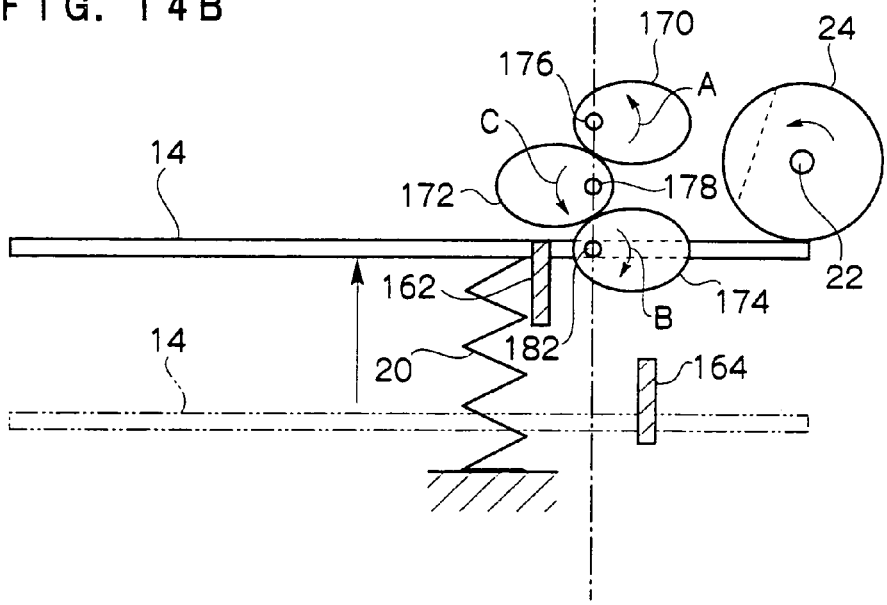

As shown in FIG. 14B, at the time when the first cams 170 rotate 90° in the direction of arrow A due to the rotation of the supporting shaft 176, when the third cams 172 followingly rotate 90° in the direction of arrow C, the rotation of the third cams 172 is restricted due to the pins and the receiving portions which are not shown. Accompanying the rotation of the third cams 172, the second cams 174 also followingly rotate 90° in the direction of arrow B, and the rotation of the second cams 174 is restricted due to the pins and the receiving portions which are not shown.

Due to respective portions of the first cams 170, the third cams 172, and the second cams 174, at which portions the eccentric radii are small, abutting one another, the presser plate 14 rises to its topmost position. When the presser plate 14 is raised, the sheets P are supplied by the feed roller 24 (see FIG. 1).

Figure 15A:
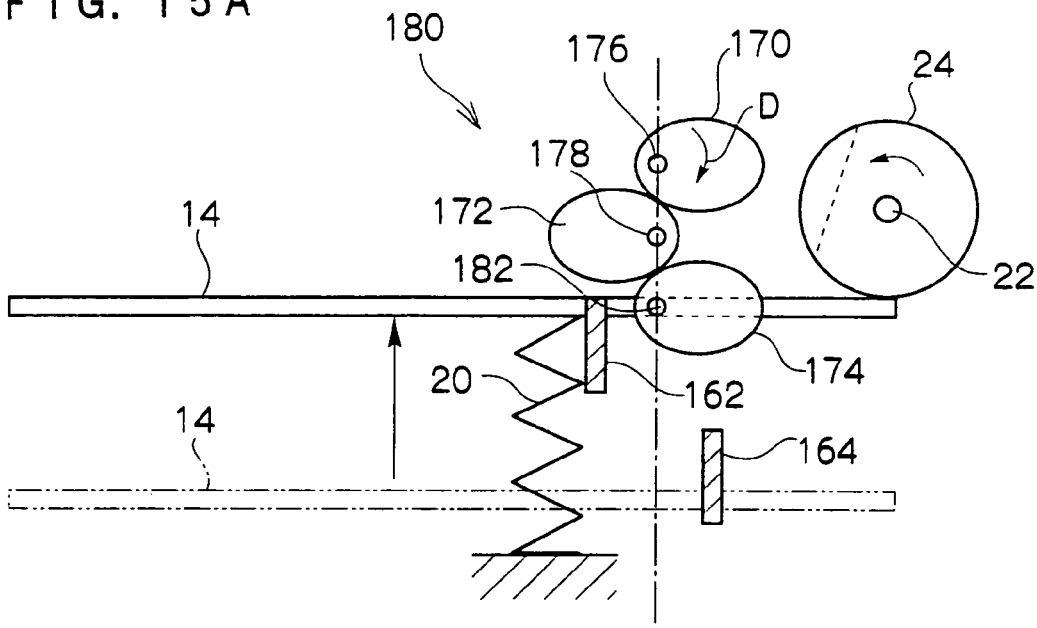
FIGS. 15A and 15B are side views showing other workings of the sheet supplying device of the fifth embodiment.

Thereafter, as shown in FIG. 15A, when the first cams 170 are driven to rotate in the direction of arrow D (the direction opposite to the direction of arrow A) by the supporting shaft 176, the lowering of the presser plate 14 due to the rotation of the first cams 170 begins. At this time, the third cams 172 and the second cams 174 remain stopped because their rotation is restricted.

Figure 15B:
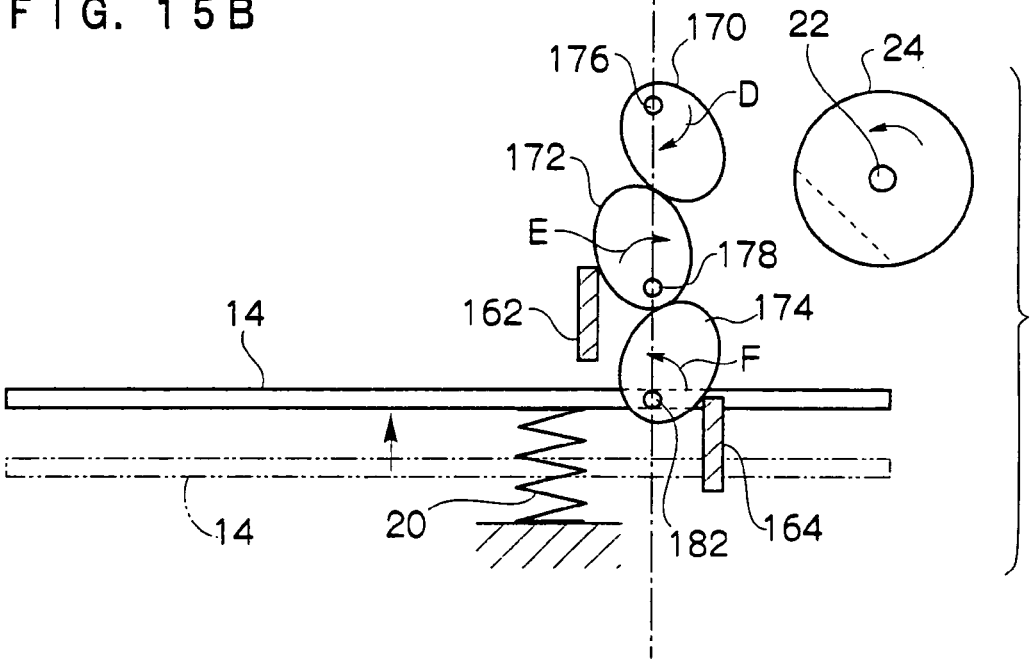
Figure 16:
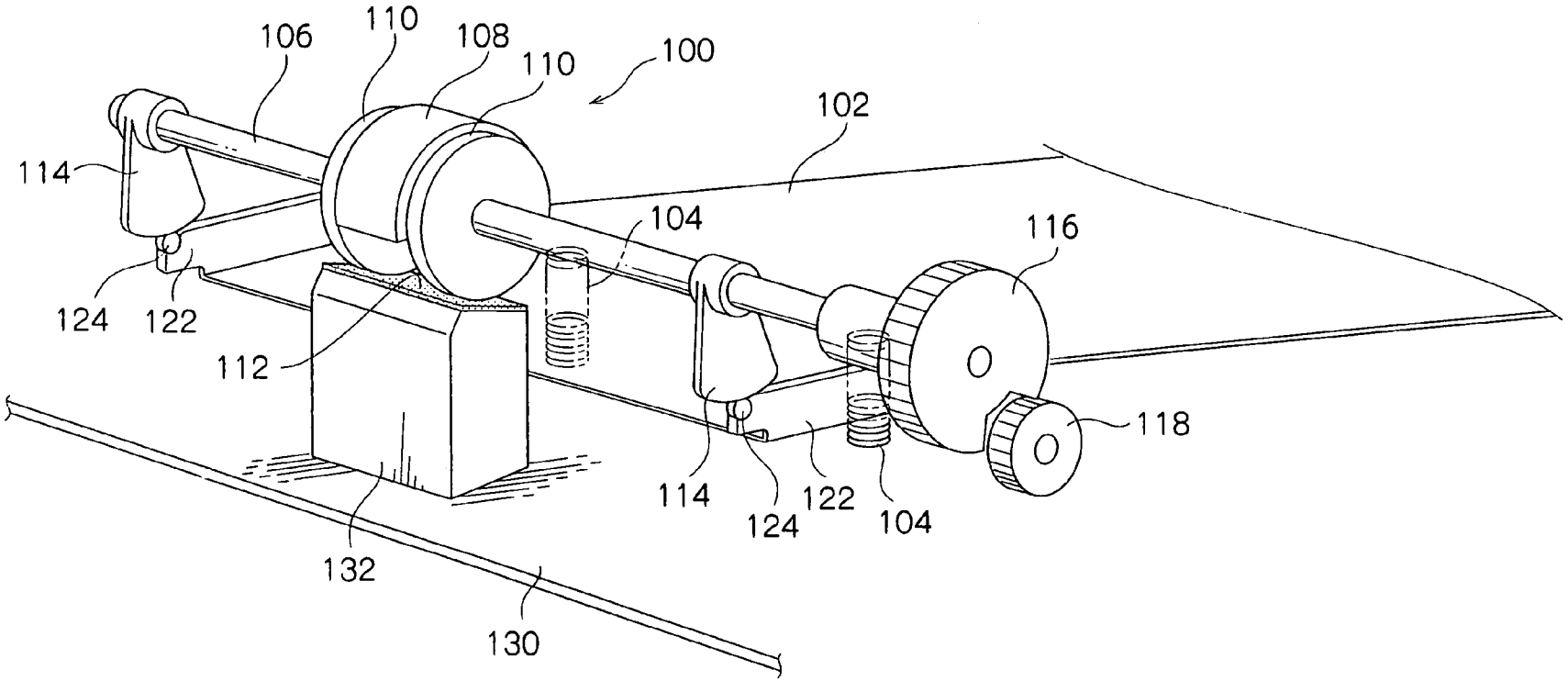
FIG. 16 PRIOR ART
FIG. 16 is a perspective view showing a conventional sheet supplying device.
Figure 17A:
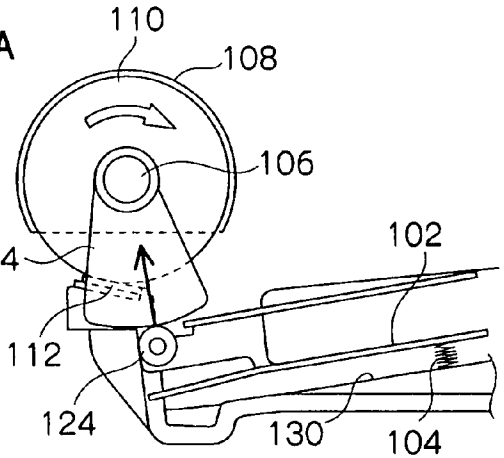
FIG. 17A PRIOR ART
FIGS. 17A through 17D are side views showing workings of the conventional sheet supplying device.
Figure 17B:
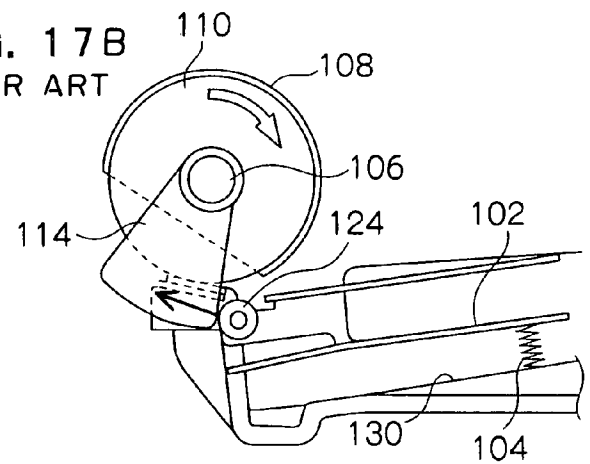
FIG. 17B PRIOR ART
Figure 17C:
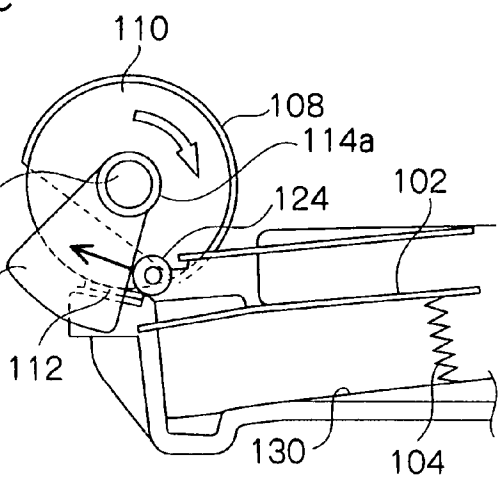
FIG. 17C PRIOR ART
Figure 17D:
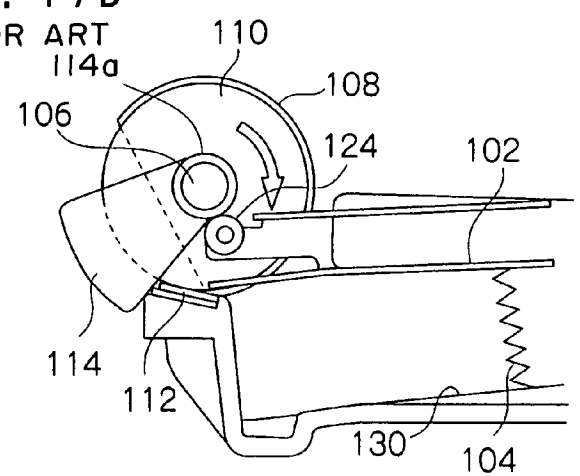
FIG. 17D PRIOR ART

As shown in FIG. 15B, when the first cams 170 rotate further in the direction of arrow D, the third cams 172 abut the second cam followers 162, and thereby rotate followingly in the direction of arrow E.

Moreover, due to the second cams 174 abutting the second cam followers 164, the second cams 174 rotate followingly in the direction of arrow F, and push the presser plate 14 downward.

The presser plate 14 moves downward to its lowermost position due to the first cams 170 rotating further in the direction of arrow D, and the portions of the first cams 170, the third cams 172, and the second cams 174, at which portions the eccentric radii are large, abutting one another.

In the present sheet supplying device 180, the presser plate 14 can be moved upward and downward by the combination of the three cams. Therefore, even if the eccentric radii of the respective cams 170, 172, 174 are not made to be large, the stroke of the presser plate 14 can be made to be large. Therefore, the sheet P accommodating capacity can be increased, and the device can be made compact overall.

EMBODIMENT OF THE IMAGE FORMING DEVICE

Lastly, an embodiment of an image forming device, to which the sheet supplying device 10 of the first embodiment is applied, will be described in detail with reference to FIG. 7.

The process cartridge 204, in which an image forming section has been integrally formed into a unit, is provided in the present image forming device 200. A photosensitive body drum 216, which rotates in a given direction, is provided at the interior of the process cartridge 204. A charging roller 218, which charges the photosensitive drum, a developing roller 220, which develops an electrostatic latent image formed on the photosensitive body drum, and a transfer roller 222, which transfers the developed toner image on the photosensitive body drum onto the sheet P, are disposed at the periphery of the photosensitive body drum 216 from the rotating direction upstream side. A cleaning member 224, which cleans the surface of the photosensitive body drum after transfer, is provided at the downstream side of the transfer roller 222 in the rotating direction of the photosensitive body drum 216. An exposure device 214, which illuminates image light onto the photosensitive body drum 216, is provided in the image forming device 200 between the charging roller 218 and the developing roller 220.

The sheet supplying devices 10 of the present invention, in which the sheet-shaped sheets P are stacked, are provided in two levels, one above the other, at the lower portion of the image forming device 200. Feeding cassettes 206, 208, in which the sheets P of respectively different sizes can be accommodated, are disposed at the sheet feeding devices 10 so as to be able to be pulled out to the exterior thereof. The feed rollers 24, which remove and convey the sheets P one-by-one as described above, are provided at the sheet P removing positions of the feeding cassettes 206, 208.

Two sets of conveying rollers 210, 211 and conveying rollers 212, 213 are provided which convey the sheets P, which have been supplied from the feed rollers 24, to a position opposing the photosensitive body drum 216 and the transfer roller 222. A fixing unit 250, which is provided with a heat roller 252 and a pressure roller 254, is installed at the downstream side of the transfer roller 22 in the conveying direction of the sheets P. A discharged sheet tray 230, to which the sheets P are discharged after fixing, is provided at the downstream side of the fixing unit 250.

An opening/closing cover 232 is provided at the image forming device 200. By opening the opening/closing cover 232, the fixing unit 250 can be installed in the image forming device 200. When the fixing unit 250 is installed in the image forming device 200, simultaneously therewith, a connector of the fixing unit 250 and a connector of the image forming device 200 are joined together. By closing the opening/closing cover 232, the image forming device 200 is set in a state in which operation is possible.

In this image forming device, an electrostatic latent image is formed on the surface of the photosensitive body drum 216 due to the photosensitive body drum 216 being charged by the charging roller 218 and image light being illuminated thereon from the exposure device 214. The electrostatic latent image is developed by the developing roller 220, such that a toner image is formed on the photosensitive body drum 216.

The sheet P is supplied from the feeding cassette 206 of the sheet supplying device 10 due to the rotation of the feed roller 24, and the sheet P is conveyed by the conveying rollers 210, 211 and the conveying rollers 212, 213 to the position opposing the photosensitive body drum 216 and the transfer roller 222. Then, the toner image on the photosensitive body drum 216 is transferred onto the sheet P by the transfer roller 222. Due to the application of heat and pressure between the heat roller 252 and the pressure roller 254 of the fixing unit 250, the toner image on the sheet P is fused such that the image is fixed on the sheet P. Thereafter, the sheet P on which the image has been formed is discharged out to the discharged sheet tray 230.

In the image forming device 200 in which the sheet supplying device 10 of the first embodiment is incorporated, when the presser plate 14 is raised up and the sheet P is supplied by the rotation of the feed roller 24, the presser plate 14 and the supporting shaft 22 of the feed roller 24 do not interfere with one another, and the accommodating capacity of the sheets P can be increased even if the first cams 30 are not made to be large. Namely, the sheet supplying device 10, and accordingly, the image forming device 200, can be made to be compact.

Note that, instead of the sheet supplying device 10 of the first embodiment, any of the sheet supplying devices of the second through fifth embodiments can be incorporated into the image forming device. In this way, the sheet P accommodating capacity can similarly be increased, and the image forming device can be made to be compact.

What is claimed is:

1. A sheet supplying device comprising:

a base;

a tray on which a stack of sheets can be placed, the tray being able to be raised and lowered with respect to the base;

a feed roller provided rotatably at the base and positioned above the tray, and when the feed roller rotates while frictionally engaging with a topmost sheet of the stack of sheets, the feed roller can convey the sheet;

a driving mechanism able to drive the feed roller to rotate;

an urging member urging the tray toward the feed roller;

a first eccentric cam rotatably provided at the base, and including a large-radius outer peripheral portion having a radius, and a small-radius outer peripheral portion having a smaller radius than the radius of the large radius outer peripheral portion, the first eccentric cam rotating directly interlockingly with rotation of the feed roller;

and a second eccentric cam rotatably pivotally connected to the tray, and including a large-radius outer peripheral portion having a radius, and a small-radius outer peripheral portion having a smaller radius than the radius of the large radius outer peripheral portion, the second eccentric cam being located below the first eccentric cam and being able to engage with the first eccentric cam, wherein the respective small-radius outer peripheral portions of the first eccentric cam and the second eccentric cam are capable of abutting one another during operation of the device, resulting in the tray being pushed upward by the urging member and approaching the feed roller so as to be able to convey the sheet, and the respective large-radius outer peripheral portions of the first eccentric cam and the second eccentric cam are capable of abutting one another during operation of the device, resulting in the tray being pressed by the large-radius outer peripheral portion of the first eccentric cam and moving away from the feed roller so as to be unable to convey the sheet.

2. The device of claim 1, further comprising a first cam follower which is attached integrally to the tray and can engage with the first eccentric cam.

3. The device of claim 2, wherein a supporting shaft which is provide in the feed roller and is attached to the first eccentric cam is not positioned on a locus of movement of the first cam follower at times when the tray is raised and lowered.

4. The device of claim 2, wherein the first eccentric cam and the first cam follower are capable of abutting one another resulting in the tray moving away from the feed roller.

5. The device of claim 2, further comprising a second cam follower which is attached integrally to the base and can engage with the second eccentric cam.

6. The device of claim 5, wherein the second eccentric cam and the second cam follower are capable of abutting one another resulting in the tray approaching the feed roller.

7. The device of claim 1, wherein the radius of the large-radius outer peripheral portion of the first eccentric cam is greater than a radius of the feed roller.

8. The device of claim 1, wherein the second eccentric cam is positioned at a lower side of the first eccentric cam.

9. The device of claim 5, further comprising an urging member which urges the large-radius outer peripheral portion of the second eccentric cam in a direction of approaching the second cam follower.

10. The device of claim 5, further comprising a third cam follower which can restrict movement of the large-radius outer peripheral portion of the second eccentric cam in a direction of moving away from the second cam follower.

11. An image forming device having a sheet supplying device, the sheet supplying device comprising: a base;

a tray on which a stack of sheet-shaped recording media can be placed, the tray being able to be raised and lowered with respect to the base;

a feed roller provided rotatably at the base and positioned above the tray, and when the feed roller rotates while frictionally engaging with a topmost recording medium of the stack of recording media, the feed roller can convey the recording medium;

a driving mechanism able to drive the feed roller to rotate;

an urging member urging the tray toward the feed roller;

a first eccentric cam provided rotatably at the base, and including a large-radius outer peripheral portion having a radius and a small-radius outer peripheral portion having a radius smaller than the radius of the large-radius outer peripheral portion, the first eccentric cam rotating directly interlockingly with rotation of the feed roller; and a second eccentric cam provided rotatably pivotally connected to the tray, and including a large-radius outer peripheral portion having a radius and a small-radius outer peripheral portion having a radius is smaller than the radius of the large-radius outer peripheral portion, the second eccentric cam being located below the first eccentric cam and being able to engage with the first eccentric cam, wherein, the respective small-radius outer peripheral portions of the first eccentric cam and the second eccentric cam are capable of abutting one another during operation of the device, resulting in the tray being pushed upward by the urging member and approaching the feed roller so as to be able to convey the recording medium, and the respective large-radius outer peripheral portions of the first eccentric cam and the second eccentric cam are capable of abutting one another during operation of the device, resulting in the tray being pressed by the large-radius outer peripheral portion of the first eccentric cam and moving away from the feed roller so as to be unable to convey the recording medium.

* * * * *